US007578487B2

(12) United States Patent
Kaneda et al.

(10) Patent No.: US 7,578,487 B2
(45) Date of Patent: Aug. 25, 2009

(54) MUSIC STAND AND ARTICLE RETAINING APPARATUS

(75) Inventors: Hideo Kaneda, Tochigi (JP); Naotaka Kishi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/876,505

(22) Filed: Oct. 22, 2007

(65) Prior Publication Data

US 2008/0116337 A1 May 22, 2008

(30) Foreign Application Priority Data

Nov. 21, 2006 (JP) ..... 2006-313985

(51) Int. Cl.
*F16B 47/00* (2006.01)
*A47B 19/00* (2006.01)

(52) U.S. Cl. ..... 248/205.8; 248/441.1

(58) Field of Classification Search ..... 248/205.5, 248/205.7, 205.8, 206.1, 206.2, 363, 467, 248/441.1, 458

See application file for complete search history.

(56) References Cited

U.S. PATENT DOCUMENTS

| | | | | |
|---|---|---|---|---|
| 2,710,609 | A * | 6/1955 | Giller | 600/247 |
| 3,020,017 | A * | 2/1962 | Watson | 248/205.8 |
| 5,087,005 | A * | 2/1992 | Holoff et al. | 248/205.8 |
| 5,970,860 | A * | 10/1999 | Yip | 99/510 |
| 6,042,353 | A * | 3/2000 | Thomas et al. | 425/12 |
| 6,045,111 | A * | 4/2000 | Hsieh | 248/551 |
| 6,143,391 | A | 11/2000 | Barnes et al. | |
| 6,663,064 | B1 * | 12/2003 | Minelli et al. | 248/205.5 |
| 6,749,160 | B1 * | 6/2004 | Richter | 248/206.2 |
| 6,913,232 | B2 * | 7/2005 | Richter | 248/205.8 |
| 2008/0061210 | A1 * | 3/2008 | Carnevali | 248/447 |
| 2008/0092717 | A1 * | 4/2008 | Dunlop | 84/329 |

FOREIGN PATENT DOCUMENTS

| | | |
|---|---|---|
| JP | 57-146130 | 9/1982 |
| JP | 57-160421 | 10/1982 |
| JP | 2-138218 | 11/1990 |
| JP | 3-20719 | 2/1991 |
| JP | 11-159519 | 6/1999 |
| JP | 2002-166382 | 6/2002 |
| JP | 2002-169542 | 6/2002 |
| JP | 2002-300431 | 10/2002 |
| JP | 2004-125080 | 4/2004 |
| JP | 3114817 | 9/2005 |

* cited by examiner

*Primary Examiner*—Korie H. Chan
(74) *Attorney, Agent, or Firm*—Oblon, Spivak, McClelland, Maier & Neustadt, P.C.

(57) ABSTRACT

Disclosed herein is a music stand including, a music paper receiving frame, and a suction cup device configured to support said music paper receiving frame.

10 Claims, 21 Drawing Sheets

MUSIC STAND AND ARTICLE RETAINING APPARATUS

CROSS REFERENCES TO RELATED APPLICATIONS

The present invention contains subject matter related to Japanese Patent Application JP 2006-313985 filed in the Japan Patent Office on Nov. 21, 2006, the entire contents of which being incorporated herein by reference

BACKGROUND OF THE INVENTION

1. Field of the Invention

This invention relates to a music stand and article retaining apparatus.

2. Description of the Related Art

A music stand is available which supports music paper (music score) so that a user can look at the same when the user plays a musical instrument or in a like case. One of such music stands is disclosed, for example, in Japanese Patent Laid-Open No. 2002-169542.

The music stand includes a music paper receiving frame for receiving music paper, a support having the music paper receiving frame attached at an upper end thereof, and three legs attached to and extending radially from a lower end of the support.

SUMMARY OF THE INVENTION

However, such a music stand of the past as described above is disadvantageous in that, since it is necessary for the legs of the music stand to be received by a flat floor face, the place at which the music stand is to be located is limited to a place of an area sufficient to allow the legs to be received so as to support the music stand stably. The music stand of the past further has a drawback that it is fallen down if it is hit by a person.

Therefore, it is desired to provide a music stand and an article retaining apparatus which can be installed without being placed on the floor and is not fallen down.

According to an embodiment of the present invention, there is provided a music stand including a music paper receiving frame configured to support music paper rested thereon, and a suction cup device configured to support the music paper receiving frame, the suction cup device including a suction cup having a suction face and a rear face on the opposite sides along a thicknesswise direction thereof, a center shaft provided at the center of the rear face of the suction cup and extending in a direction away from the rear face along the thicknesswise direction, an attaching base having a skirt portion configured to cover the rear face of the suction cup and an outer tubular portion projecting from the center of the skirt portion and having the center shaft accommodated therein, and a displacement mechanism provided between the center shaft and the attaching base and configured to bias the center shaft and the attaching base in a direction in which, in a state wherein the suction face is attached to an attaching object face, an end of the skirt portion is pressed against the rear face of the suction cup or the end of the skirt portion is pressed against a portion of the attaching object face positioned on the outer side of the suction cup and displace the center shaft in a direction in which the center shaft is spaced away from the attaching object face, the music paper receiving frame and the outer tubular portion being connected to each other.

With the music stand, the music paper receiving frame can be attached to an attaching object face using the suction disc device. Therefore, the music stand can be installed making use of an attaching object face of a small area corresponding to the suction cup such as the surface of a musical instrument such as a piano or a keyboard or the surface of a table without placing the music stand on the floor.

Further, since the music paper receiving frame is supported on the attaching object face by means of the suction cup device, the music stand does not fall even if some person hits the same, different from the music stand of the past. This is advantageous when it is tried to improve the convenience in use.

DETAILED DESCRIPTION OF THE PREFERRED EMBODIMENTS

Figure 1:
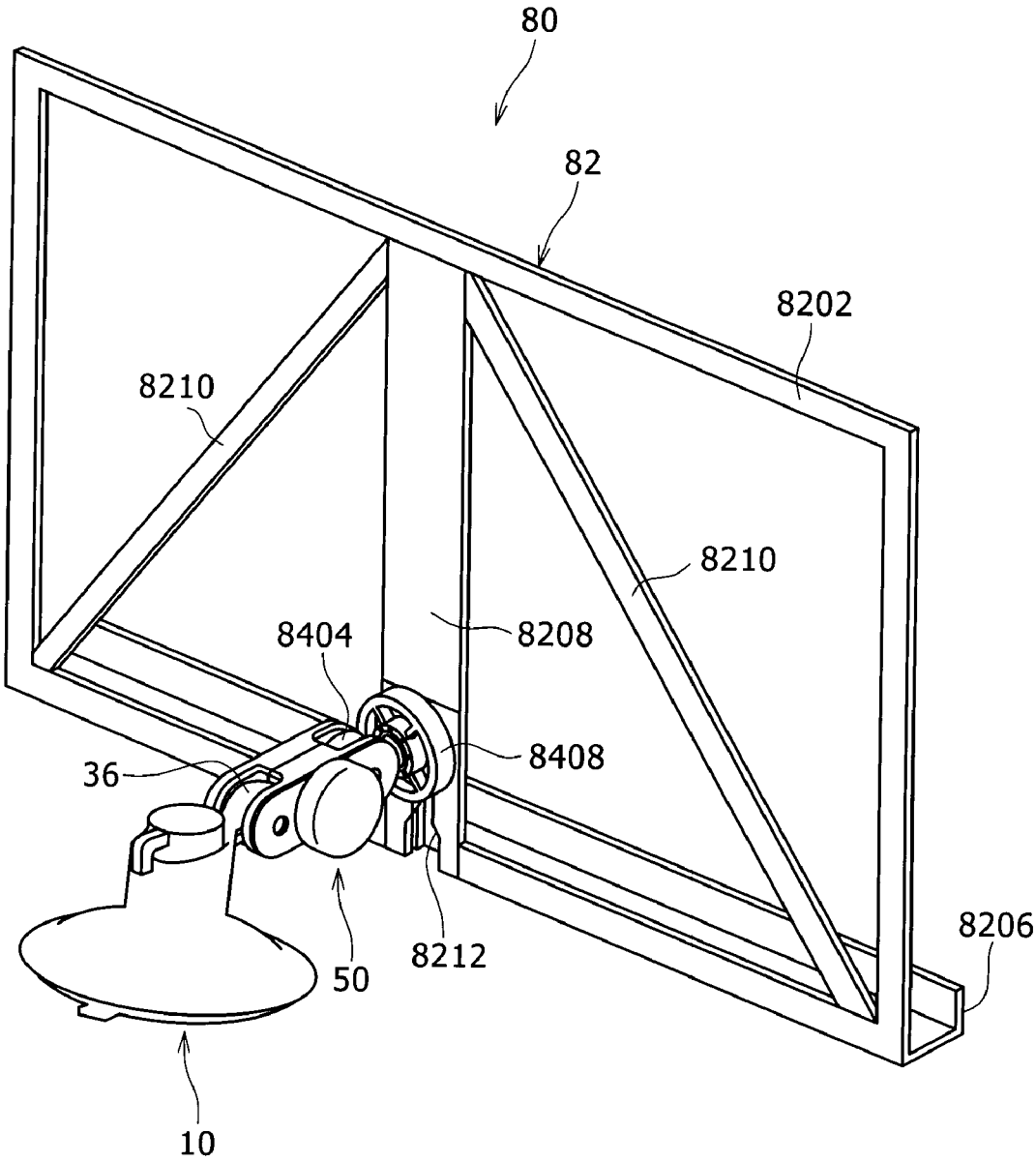
FIG. 1 is a perspective view of a music stand to which the present invention is applied.

Referring to FIG. 1, there is shown a music stand to which the present invention is applied.

The music stand 80 shown includes a music paper receiving frame 82, a suction cup device 10, and a joint 50 which connects the music paper receiving frame 82 and the suction cup device 10 to each other.

The music paper receiving frame 82 includes a frame portion 8202 formed as a rectangular framework elongated leftwardly and rightwardly, and a bottom piece 8204 projecting forwardly from the major side positioned at a lower portion of the frame portion 8202 and extending along the major side. The music paper receiving frame 82 further includes a bent piece 8206 bent upwardly from a front end of the bottom piece 8204.

The upper and lower major sides of the frame portion 8202 are connected to each other at central portions thereof by a support plate 8208 in the form of a band plate extending upwardly and downwardly. The opposite left and right sides of an upper portion of the support plate 8208 and the opposite left and right ends of the major side positioned at the lower position of the frame portion 8202 are connected to each other by a pair of brace plates 8210 each in the form of a band plate.

Accordingly, music paper is set such that the rear face thereof is received by the bottom piece 8204 and rests on the frame portion 8202.

It is to be noted that various known configurations can be adopted for the structure of such a music paper receiving frame 82 as described above.

Figure 2:
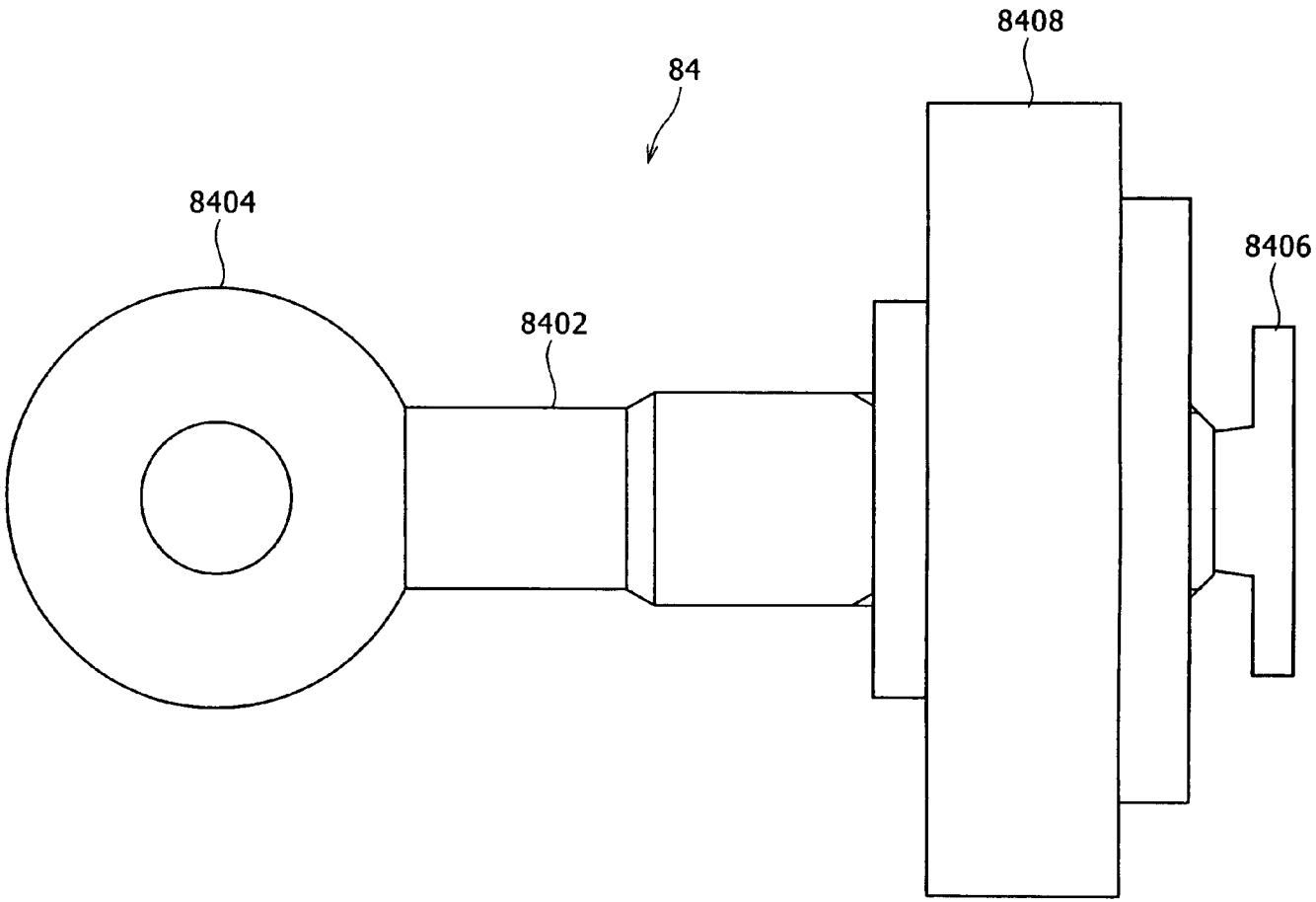
FIG. 2 is a plan view of a connector of the music stand.

FIG. 2 is a top plan view of a connector 84.

An engaging groove 8212 is formed at a lower portion of the rear face of the support plate 8208 as seen in FIG. 1, and the connector 84 is removably attached to the engaging groove 8212.

Referring now to FIG. 2, the connector 84 has a stem portion 8402, and a first spherical body 8404 is provided at one end of the stem portion 8402 while an engaging plate 8406 is provided at the other end of the stem portion 8402. The engaging plate 8406 is inserted for sliding movement on the inner side of the engaging groove 8212. A nut 8408 is provided at a portion of the stem portion 8402 rather near to the other end.

The connector 84 is attached to the rear face of the music paper receiving frame 82 such that the engaging plate 8406 thereof is inserted in the engaging groove 8212 and the nut 8408 is tightened.

It is to be noted that the first spherical body 8404 allows the joint 50 to be attached thereto and is formed in a spherical shape of a first radius.

Now, the suction cup device 10 is described with reference to FIGS. 3 to 13.

Figure 3:
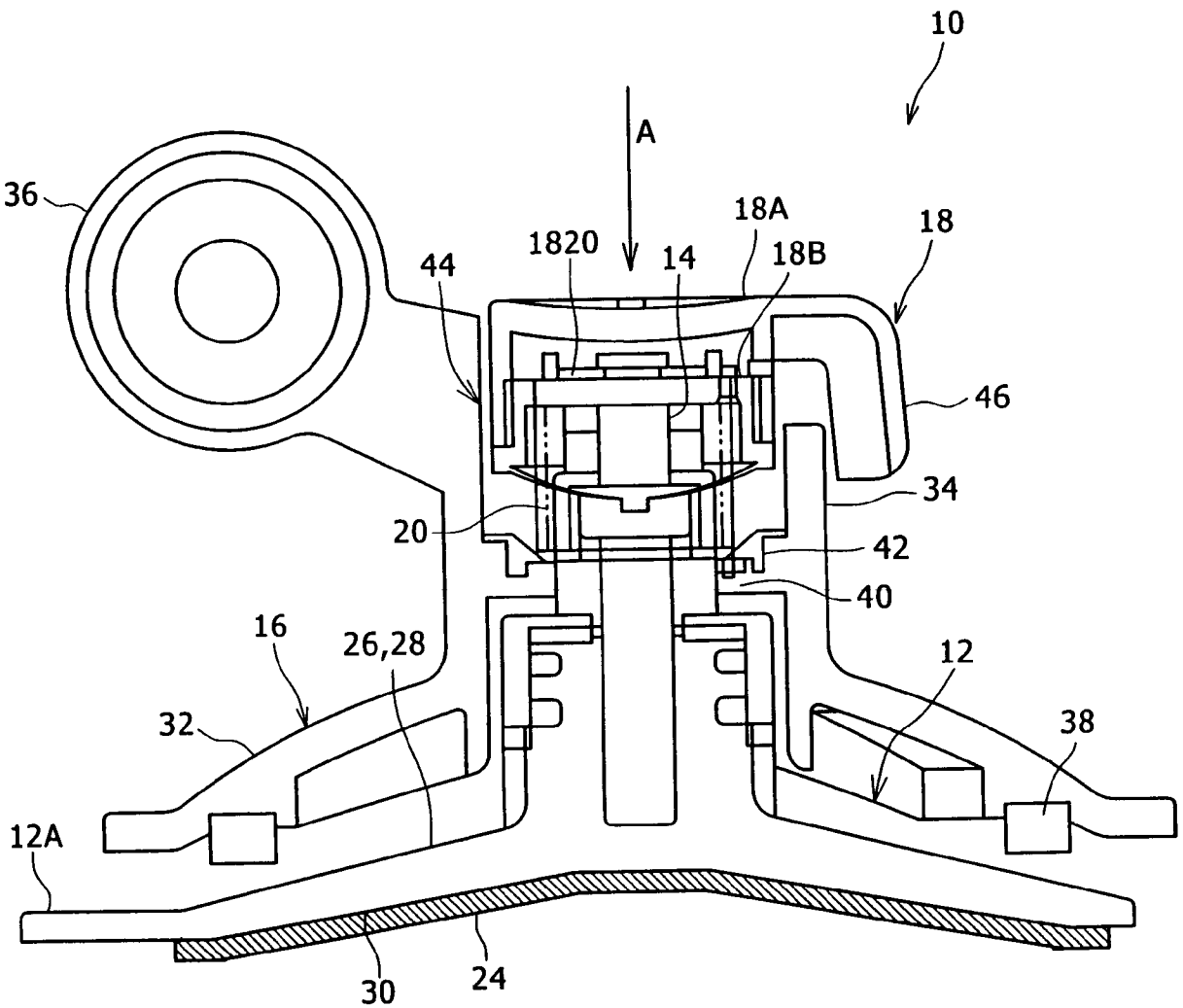
FIG. 3 is a sectional view showing a suction cup device in a non-attached state.

Referring first to FIG. 3, the suction cup device 10 includes a suction cup 12, a center shaft 14, an attaching base 16, a lock lever (sometimes referred to as a "rock lever") 18, a coil spring 20, a cam mechanism 22 (refer to FIG. 13) and so forth. In the present embodiment, the rock lever 18, coil spring 20 and cam mechanism 22 cooperatively form a displacement mechanism.

Figure 8:
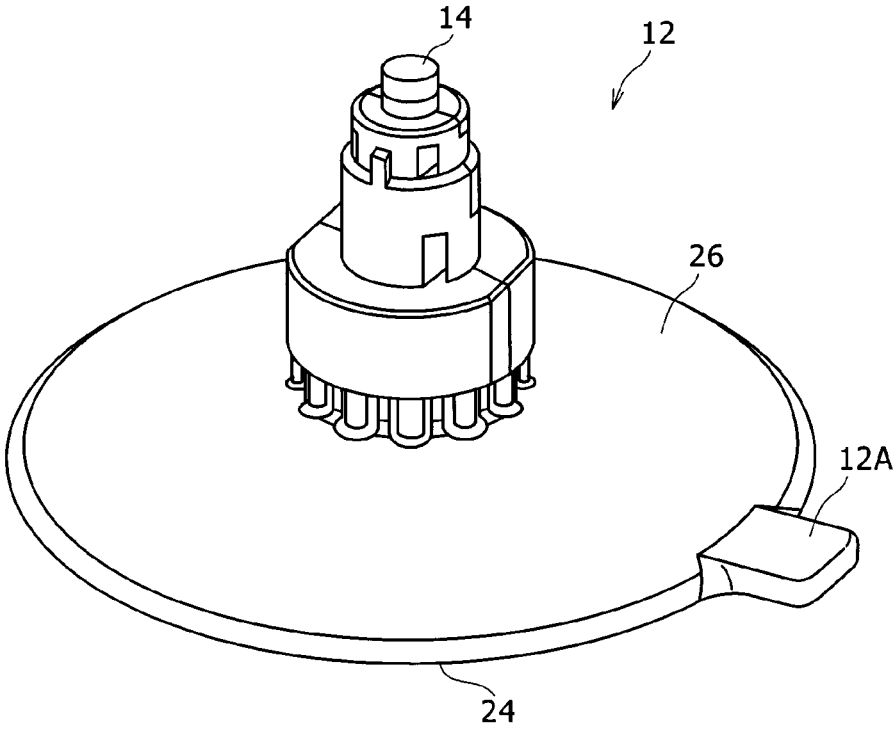
FIG. 8 is a perspective view of a suction cup of the suction cup device.

Referring to FIGS. 3 and 8, the suction cup 12 is generally in the form of a disk having two faces in the thicknesswise direction one of which is formed as a concave suction face 24 and the other of which is formed as a convex rear face 26.

The suction cup 12 can be made of various known resilient materials used for suction cups such as, for example, urethane type materials, styrene type materials and silicon resin materials.

It is to be noted that a piece portion 12A for removing operation is provided on an outer edge of the suction cup 12 such that it extends in a diametrically outward direction.

Further, the suction cup 12 can be formed in various known configurations.

Figure 9:
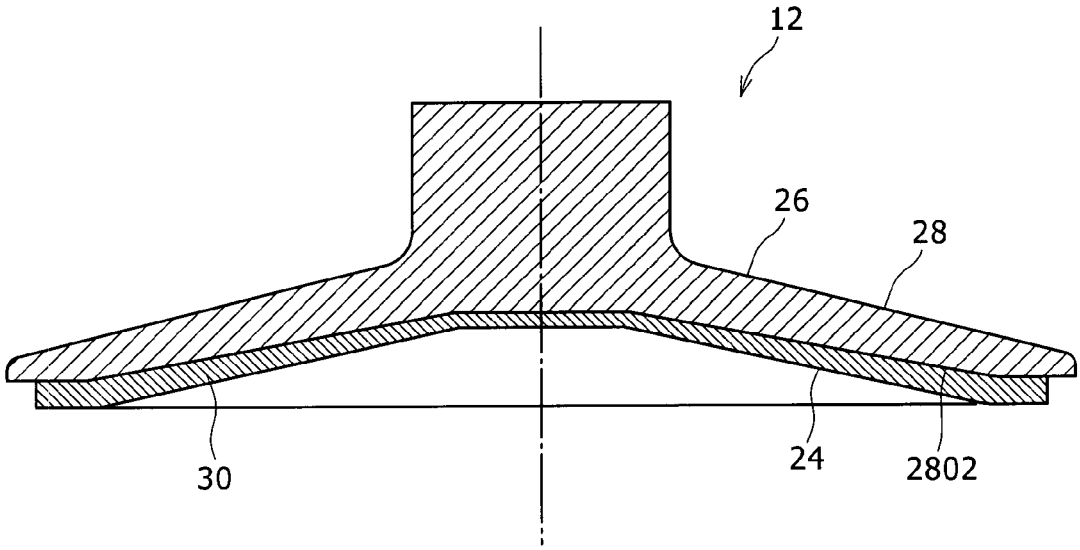
FIG. 9 is a cross sectional view of the suction cup.

Referring now to FIGS. 3 and 9, for example, the suction cup 12 may include a suction cup body 28 in the form of a disk which forms the rear face 26 and a gel layer 30 which forms the suction face 24.

The suction cup body 28 can be made of synthetic resin materials having resiliency, for example, various known resilient materials used for suction cups such as urethane type materials, styrene type materials and silicon resin materials similarly to the suction cup 12.

The gel layer 30 is made of gel and bonded to a concave attaching face 2802, which is formed on a face of the suction cup body 28 positioned remotely from the rear face 26, in such a manner as to cover the attaching face 2802. The suction face 24 is formed from the surface of the gel layer 30.

For such gel, gel of a synthetic resin type such as a polyethylene type, a styrene type and the silicon resin type can be used. Further, as the gel of the polyethylene type, for example, "COSMO SUPER GEL" by Cosmo Instruments Co., Ltd. which is an article on the market can be used. As the gel of the styrene type, for example, "NAGFLEX" by Inoac Corporation which is an article on the market can be used. As the gel of the silicon type, for example, "αGEL" (alpha gel) by GELTEC Co., Ltd. which is an article on the market can be used.

Further, for the bonding of the gel layer 30 to the attaching face 2802, such a method of bonding by two-color molding or by means of a bonding agent can be adopted.

Where the suction face 24 is formed from the gel layer 30, even if the attaching object face 2 is formed as a leather embossed face which has fine convexes and concaves or provides a coarse feel, the suction face 24 is deformed following up the convex and concave geometry. Consequently, the suction face 24 can contact closely with the convex and concave face or coarse face without allowing a gap formed therebetween. This is advantageous in that various articles are attached with certainty to an attaching object face 2 such as a leather embossed face of the dashboard panel or the like.

Referring to FIG. 3, the center shaft 14 extends in a direction away from the rear face 26 along the thicknesswise direction of the suction cup 12, that is, along the center axis of the suction face 24, from a central portion of the rear face 26 of the suction cup 12.

The center shaft 14 is formed from a material having rigidity such as, for example, a metal or a hard synthetic resin and is embedded at a lower end thereof in a swollen portion at the center of the suction cup 12.

The attaching base 16 supports such the joint 50 and the music piece receiving frame 82 on the suction cup 12.

The attaching base 16 is formed from a material having rigidity such as a hard synthetic resin material.

Figure 10:
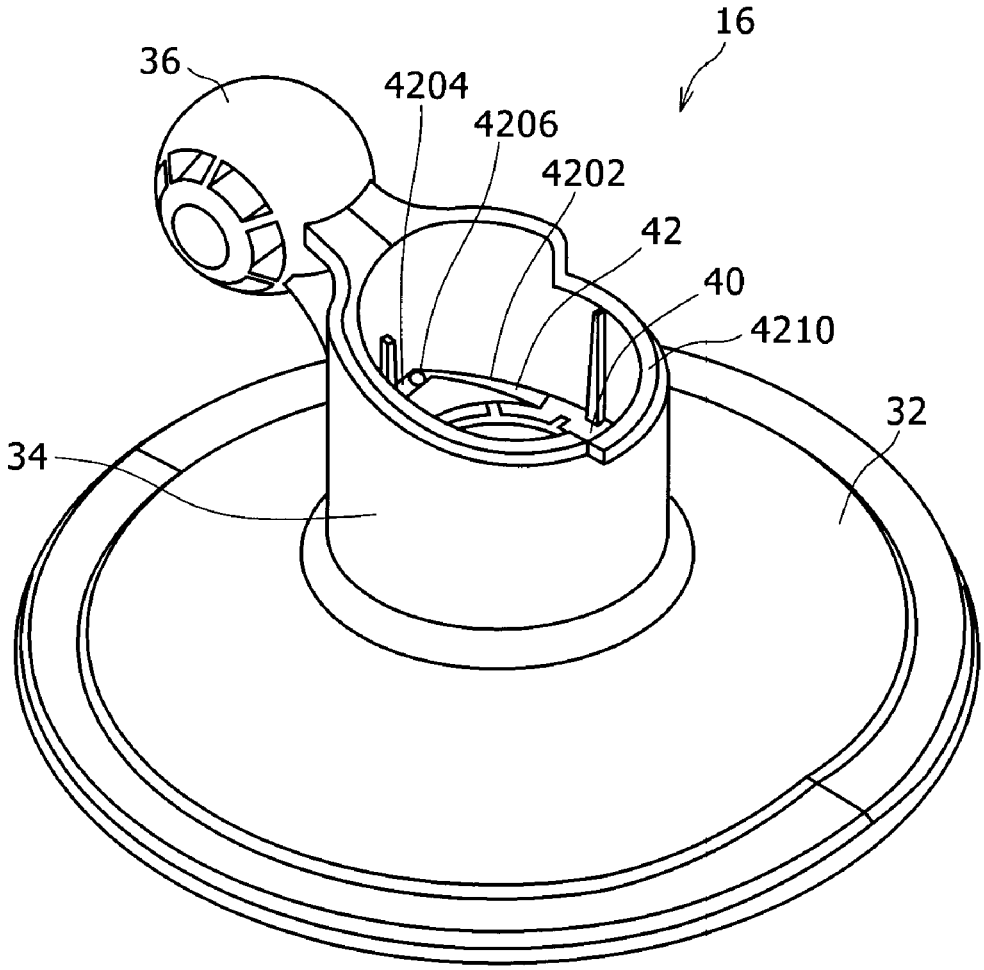
FIG. 10 is a perspective view of an attaching base of the suction cup device.
Figure 11A:
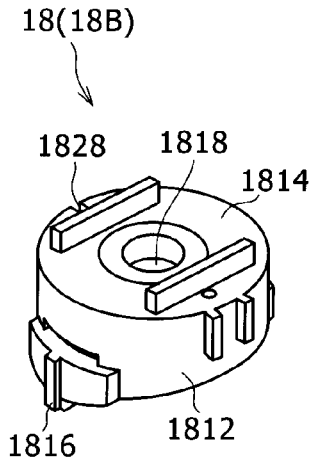
FIGS. 11A and 11B are perspective views of a second member of a rock lever of the suction cup device and FIGS. 11C and 11D are perspective views of a first member of the rock lever.
Figure 11C:
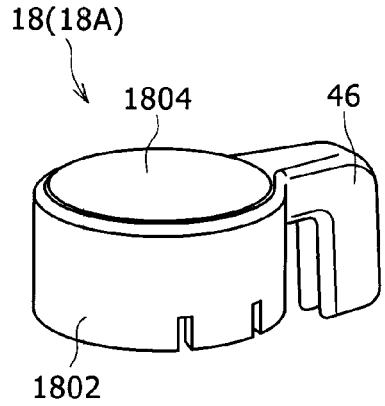
Figure 11B:
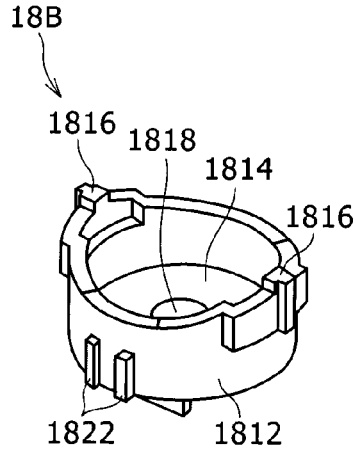
Figure 11D:
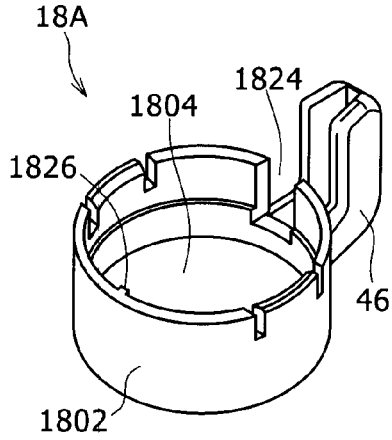

The attaching base 16 has a skirt portion 32, an outer tubular portion 34, a second sphere 36 and so forth as seen in FIG. 10.

The skirt portion 32 has a spherical surface shape and covers the rear face 26 of the suction cup 12.

Referring to FIG. 3, a resilient member 38 is provided along an overall circumference of an end of the skirt portion 32.

The resilient member 38 is formed from a resilient material having a hardness lower than that of the resilient material of the suction cup 12 such that it can be deformed readily in accordance with the shape of the attaching object face 2. In particular, even if the attaching object face 2 has a non-planar shape such as a spherical shape or a cylindrical shape, the resilient member 38 is deformed following up the shape of the attaching object face 2. Consequently, the suction cup 12 is advantageously allowed to be attached with certainty to the attaching object face 2 of such non-planar shape.

More particularly, the suction cup 12 is formed from a resilient material having a JIS-A hardness of 70 or more while the resilient member 38 is formed from a resilient material of another JIS-A hardness of 40 or more but less than 70.

As such resilient materials, typically a polyurethane foam material can be used, and for example, "PORON" by Inoac Corporation which is an article on the market can be used.

The resilient member 38 has a thickness in a direction parallel to the thicknesswise direction of the suction cup 12 and has an annular belt-like plate shape centered at the center of the suction cup 12, that is, centered at the center of the skirt portion 32.

The resilient member 38 is a portion of the skirt portion 32 which is contacted by the rear face 26 of the suction cup 12 in an initially attached state, an intermediately attached state and a finally attached state hereinafter described. It is to be noted that the resilient member 38 may be omitted such that the end of the skirt portion 32 is contacted directly with the outer circumference of the rear face 26 of the suction cup 12 or the end of the skirt portion 32 is contacted with a portion of the attaching object face 2 which is positioned on the outer side of the suction cup 12 as indicated by reference character a in FIG. 4.

The outer tubular portion 34 is erected uprightly from the center of the skirt portion 32 and has the center shaft 14 accommodated on the inner side thereof.

Referring to FIGS. 3 and 10, an intermediate wall 40 is provided on the inner circumference of an intermediate portion in an axial direction of the outer tubular portion 34 such that it projects in a radially inward direction.

Meanwhile, two cams 42 are provided at portions of the inner circumference of the outer tubular portion 34 positioned on the intermediate wall 40 and spaced by 180 degrees from each other such that they extend along a circumferential direction of the inner circumference of the outer tubular portion 34.

Figure 13:
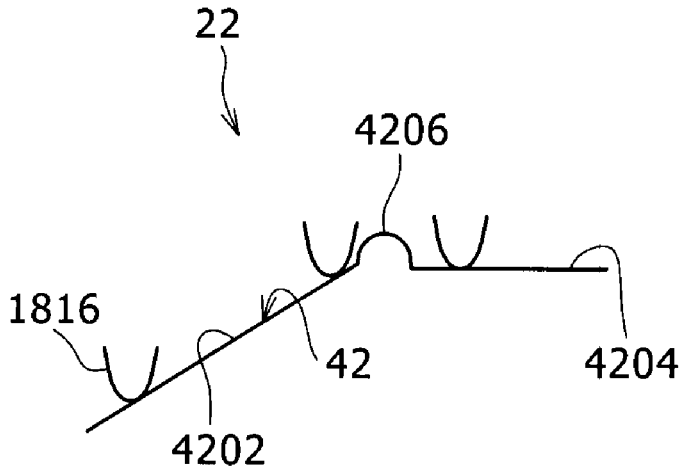
FIG. 13 is a schematic view illustrating operation of a cam mechanism of the suction cup device.

Referring to FIGS. 10 and 13, each of the cams 42 includes an inclined cam 4202, an upper cam 4204 and a locking projection 4206. The inclined cam 4202 extends along a circumferential direction on the inner circumference of the outer tubular portion 34 while being displaced in a direction toward an end of the center shaft 14. The upper cam 4204 connects to an upper end of the inclined cam 4202 displaced most in the direction toward the end of the center shaft 14 and extends along the circumferential direction on the inner circumference of the outer tubular portion 34 at a height substantially equal to the upper end of the inclined cam 4202. The locking projection 4206 is provided at a portion of the upper cam 4204 rather near to the inclined cam 4202.

Referring to FIG. 10, a cutaway portion 4210 is formed at an end portion in an axial direction of the outer tubular portion 34 remote from the suction cup 12 such that it extends along the circumferential direction of the outer tubular portion 34. The cutaway portion 4210 is provided to allow the rock lever 18 to rock between an initial position and a locked position (sometimes referred to as the "rocked position"). More particularly, a lever portion 46 hereinafter described is arrested by one end of the cutaway portion 4210 in the extension direction to define the initial position, and is arrested by the other end of the cutaway portion 4210 in the extension direction to define the rocked position.

The second sphere 36 is provided at an end portion in the axial direction of the outer tubular portion 34 remote from the suction cup 12 as seen in FIG. 3.

The second sphere 36 is a portion to which the joint 50 is attached and is formed in the form of a sphere having a second radius. It is to be noted that, in the present embodiment, the first radius and the second radius are equal to each other.

Figure 7A:
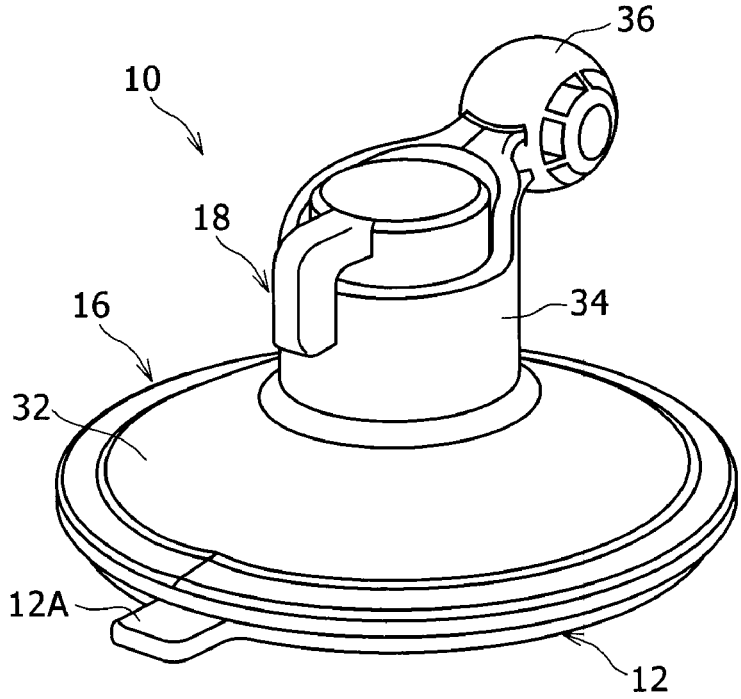
FIGS. 7A and 7B are perspective views showing the suction cup device in the intermediately attached state and the finally attached state, respectively.
Figure 7B:
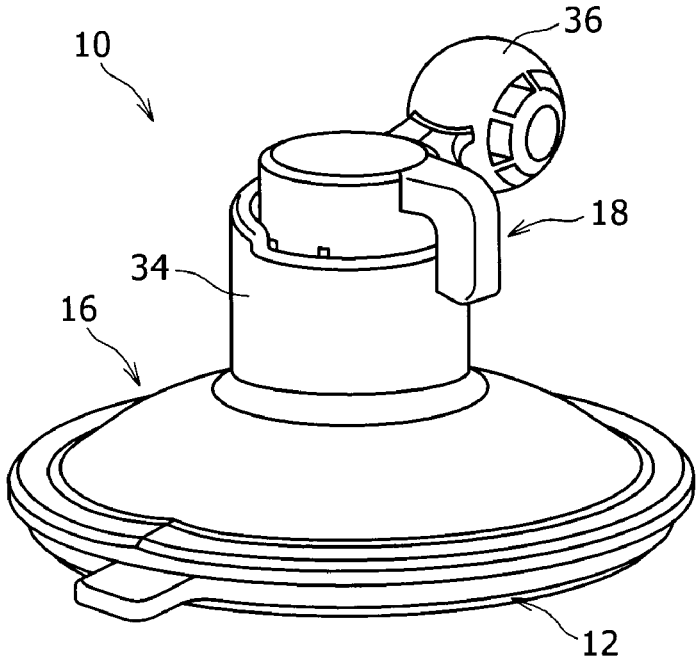

The rock lever 18 is coupled to an end portion of the center shaft 14 against movement in an axial direction of the center shaft 14 but for rotation between such an initial position as seen in FIG. 7A and such a rocked position as seen in FIG. 7B in a circumferential direction of the center shaft 14.

The rock lever 18 is formed from a material having rigidity such as a hard synthetic resin material.

The rock lever 18 has an inner tubular portion 44 inserted between the outer circumference of the center shaft 14 and the inner circumference of the outer tubular portion 34 and coupled to the center shaft 14 against movement in the axial direction of the center shaft 14 but for rotation around the center shaft 14. The rock lever 18 further has a lever portion 46 for rotating operation extending outwardly in a radial direction of the inner tubular portion 44 from the inner tubular portion 44.

In the present embodiment, the rock lever 18 is formed from two members including a first member 18A and a second member 18B as seen in FIGS. 11A to 11D.

The first member 18A has a tubular portion 1802 and a first end wall 1804 which closes up one end in an axial direction of the tubular portion 1802. The lever portion 46 is provided in a projecting manner on the tubular portion 1802.

The second member 18B has a tubular portion 1812, and a second end wall 1814 which closes up one end in an axial direction of the tubular portion 1812. A pair of projections 1816 engage with the cams 42 are provided at different portions, spaced by a distance of 180 degrees from each other, at the other end portion in the axial direction of the tubular portion 1812 positioned rather near to the suction cup 12. A hole 1818 is formed at the center of the second end wall 1814.

In the present embodiment, the cam mechanism 22 is formed from the cams 42 of the outer tubular portion 34 and the projections 1816 of the second member 18B as seen in FIG. 13.

Assembly of the first member 18A and the second member 18B is performed in the following manner.

First, the tubular portion 1812 of the second member 18B is inserted between the outer circumference of the center shaft 14 and the inner circumference of the outer tubular portion 34 as seen in FIGS. 3 and 11A to 11D. Then, an end portion of the center shaft 14 is inserted into the hole 1818, and a stop ring 1820 is attached to a portion of the center shaft 14 which projects from the hole 1818 thereby to attach the second member 18B to the end portion of the center shaft 14 against movement in the axial direction but for rotation in a circumferential direction of the center shaft 14.

Then, the first member 18A is fitted to the outer side with and fixed to the second member 18B.

This fitting fixation is performed such that projections 1822 (refer to FIG. 11B) of the tubular portion 1812 of the second member 18B are fitted into cutaway portion 1824 (refer to FIG. 11D) of the tubular portion 1802 of the first member 18A and a projection 1826 (refer to FIG. 11D) on the inner circumference of the tubular portion 1802 of the first member 18A is fitted into a recess 1828 (refer to FIG. 11A) on the outer circumference of the tubular portion 1812 of the second member 18B.

Accordingly, in the present embodiment, the inner tubular portion 44 (refer to FIG. 3) is formed from the tubular portion 1802 of the first member 18A and the tubular portion 1812 of the second member 18B.

Then, the first and second members 18A and 18B are attached to the center shaft 14 such that the lever portion 46 is positioned above the cutaway portion 4210 (refer to FIG. 10). More particularly, the first and second members 18A and 18B are attached to the center shaft 14 such that the projections 1816 are positioned between the two cams 42 while the lever portion 46 is positioned at the initial position at one end portion of the cutaway portion 4210 in the extension direction.

The first end wall 1804 and the second end wall 1814 are positioned closely to each other in a state wherein the first and second members 18A and 18B are fitted on the center shaft 14, and the first end wall 1804 is provided at an end portion in the axial direction of the inner tubular portion 44 positioned rather near to the end portion of the center shaft 14 such that it closes up the end portion of the inner tubular portion 44. Further, the second end wall 1814 is provided at a portion in the inside of the inner tubular portion 44 rather near to the first end wall 1804 such that it projects inwardly in a radial direction of the inner tubular portion 44.

Figure 12:
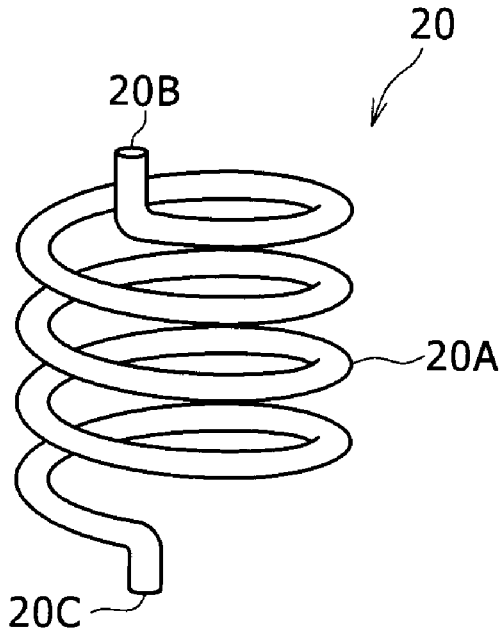
FIG. 12 is a perspective view of a coil spring of the suction cup device.

Referring to FIG. 12, the coil spring 20 has a coiled portion 20A, and a pair of end portions 20B and 20C bent at the opposite ends of the coiled portion 20A.

Referring to FIG. 3, the coiled portion 20A of the coil spring 20 is disposed around the center shaft 14 on the inner side of the outer tubular portion 34, and the end portion 20B is anchored by the outer tubular portion 34 while the end portion 20C is anchored by the rock lever 18 to bias the rock lever 18 toward the initial position and bias the outer tubular portion 34 and the rock lever 18 to move away from each other along the center shaft 14.

Figure 4:
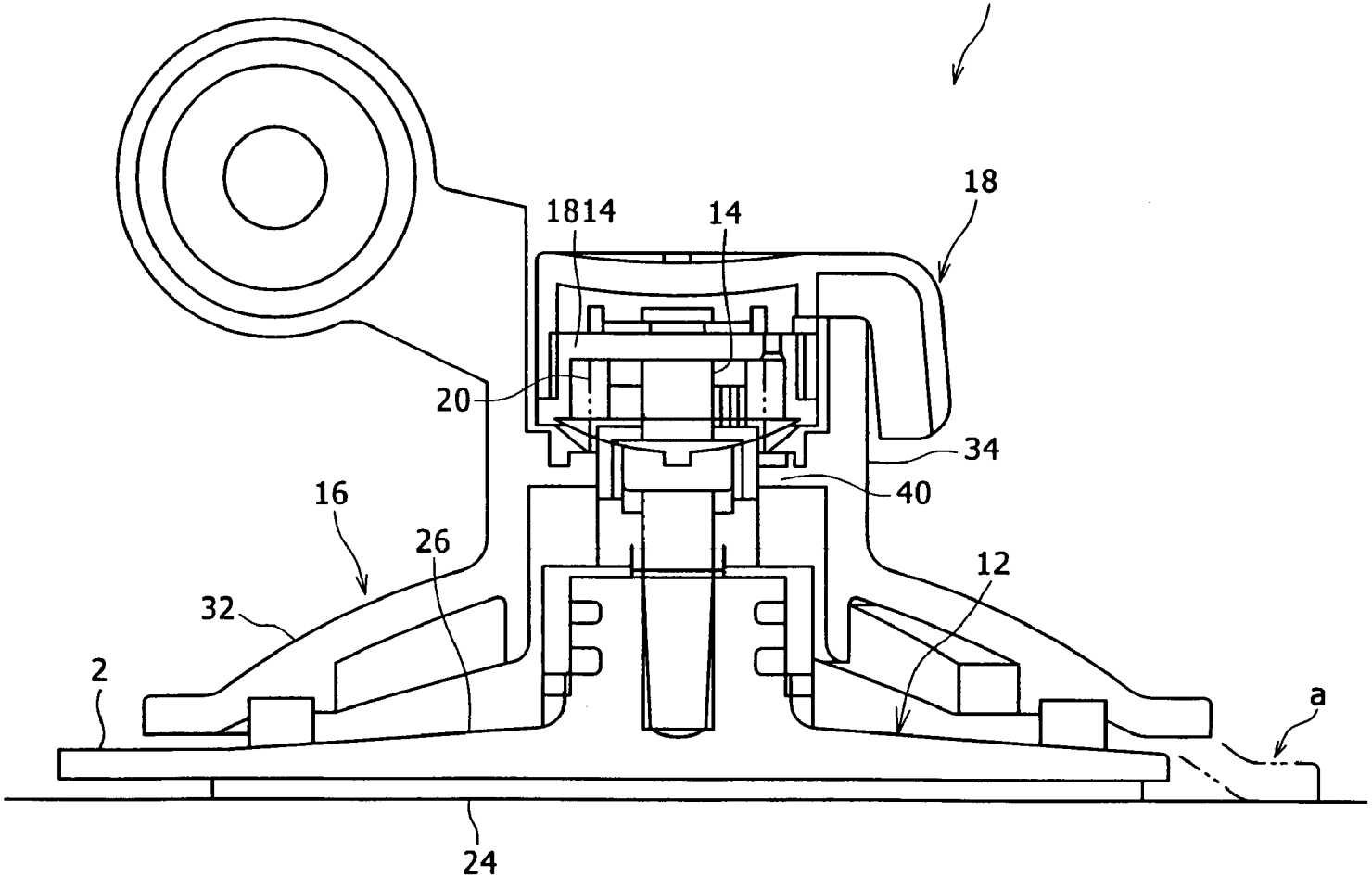
FIG. 4 is a sectional view of the suction cup device in an initially attached state.

More particularly, the coil spring 20 is disposed between the second end wall 1814 and the intermediate wall 40 around the center shaft 14 as seen in FIG. 4. The coil spring 20 is anchored at the end portion 20B thereof by the intermediate wall 40 and at the end portion 20C thereof by the second end wall 1814 and biases the rock lever 18 toward the initial position while it biases the outer tubular portion 34 and the center shaft 14 to move away from each other.

In the present embodiment, the coil spring 20 is provided to exert resilient force for obtaining an intermediately attracted position hereinafter described.

Now, operation of the suction cup device 10 is described.

If the suction face 24 of the suction cup 12 is opposed to the attaching object face 2 and the center shaft 14 is pressed against the attaching object face 2 until the suction face 24 is contacted over an overall area thereof with the attaching object face 2 and the end of the skirt portion 32 is contacted with an outer circumferential portion of the rear face 26 or with a portion (refer to a in FIG. 4) of the attaching object face 2 on the outer side in a radial direction of the rear face 26. The initially attached state illustrated in FIGS. 4 and 7A is established thereby. It is to be noted that the operation of pressing the center shaft 14 against the attaching object face 2 is performed by a user pressing the first end wall 1804 of the rock lever 18 with its finger.

Figure 6:
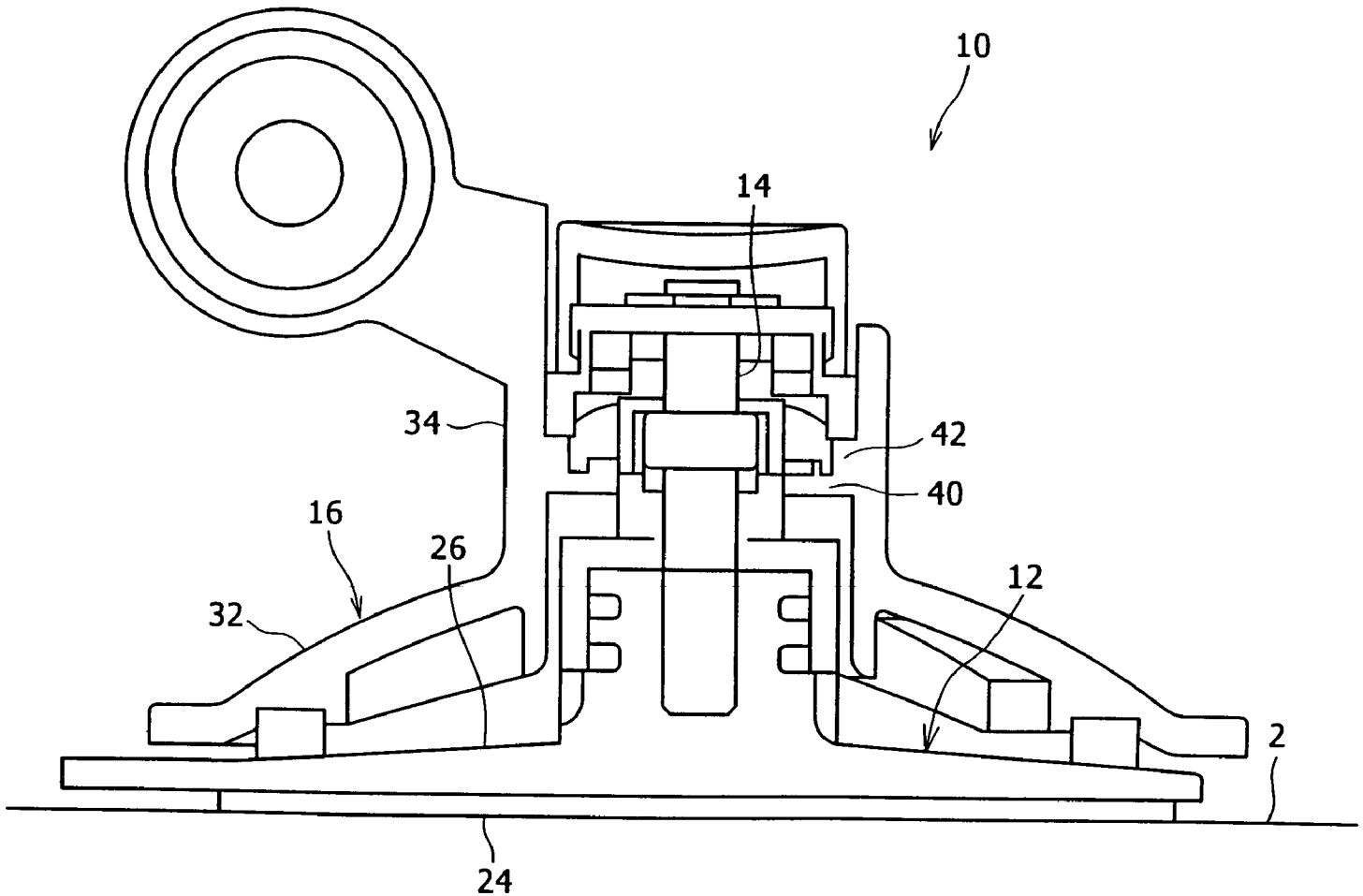
FIG. 6 is a sectional view of the suction cup device in a finally attached state.

If the rock lever 18 is turned from the initial position to the rocked position while the suction cup device 10 is in the initially attached state described above, then the center shaft 14 is displaced compulsorily in a direction away from the attaching object face 2 by the cam mechanism 22 thereby to establish the finally attached state illustrated in FIGS. 6 and 7B.

More specifically, if the rock lever 18 is turned from the initial position to the rocked position, then the projections 1816 slidably move on the inclined cams 4202 as seen in FIG. 13. Consequently, the center shaft 14 is displaced compulsorily in a direction away from the attaching object face 2. The projections 1816 soon ride over the locking projections 4206 and come to the upper cams 4204. While the rock lever 18 tends to return to the initial position by the biasing force of the coil spring 20, since the projections 1816 engage with the locking projections 4206, the rock lever 18 remains at the rocked position.

Figure 5:
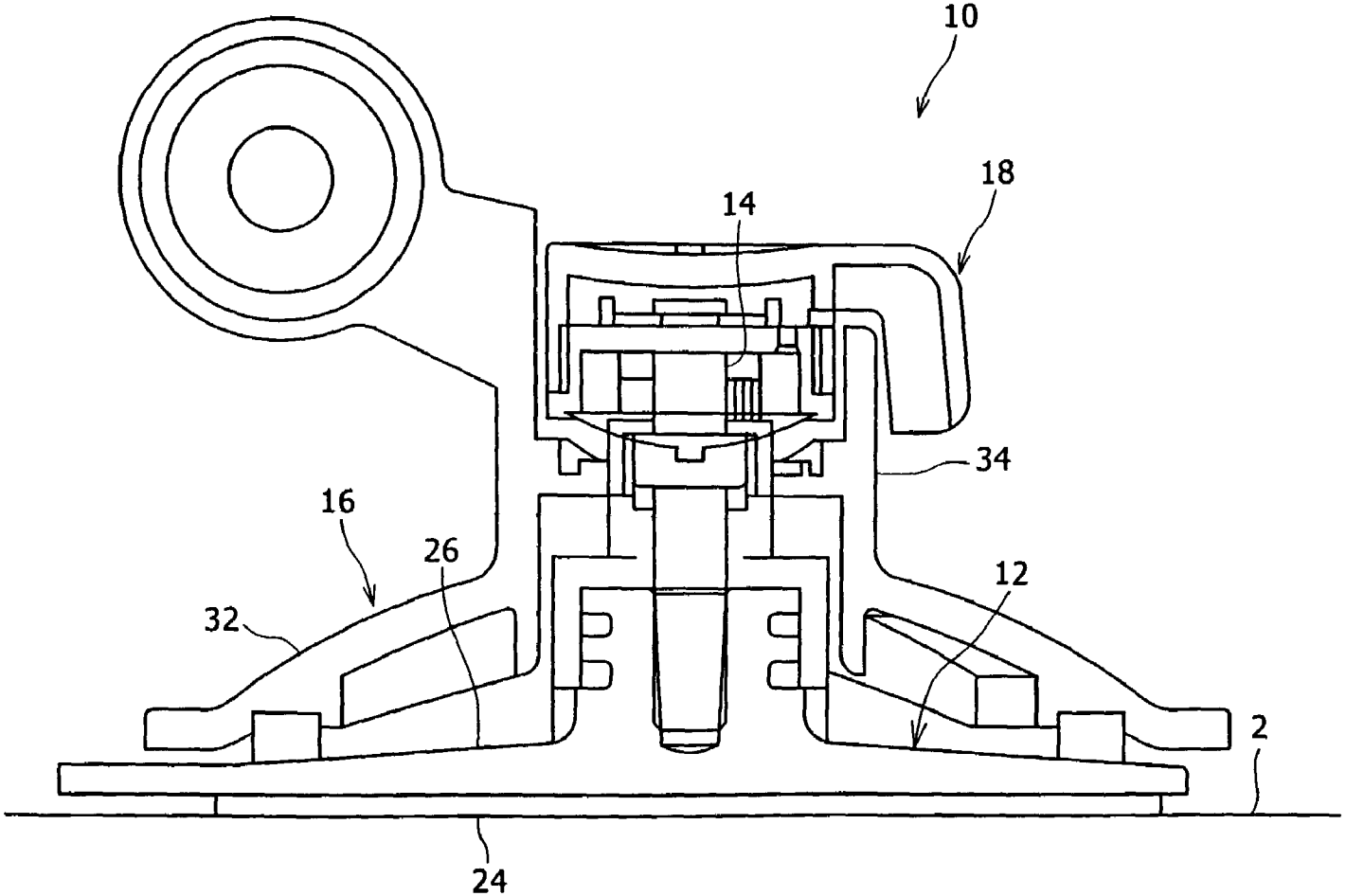
FIG. 5 is a sectional view of the suction cup device in an intermediately attached state.

In the present embodiment, if the first end wall 1804 of the rock lever 18 is released from the finger while the suction cup device 10 is in the initially attached state, then the rock lever 18 is moved to the intermediately attached position illustrated in FIG. 5 by the coil spring 20.

The intermediately attached position is established by the center shaft 14 being displaced in a direction away from the attaching object face 2 by the resilient force of the coil spring 20 in the initially attached state.

Accordingly, in the suction cup device 10, the finally attached state is established when, while the suction cup device 10 is in the intermediately attached state, the rock lever 18 is rotated from the initial position to the rocked position to further displace the center shaft 14 in the direction away from the attaching object face 2.

The suction cup device 10 is attached firmly to the attaching object face 2 in such a finally attached state as just described.

On the other hand, removal of the suction cup device 10 from the attaching object face 2 is performed by exfoliating the piece portion 12A from the attaching object face 2 to exfoliate the suction cup 12.

If the suction cup 12 is removed from the attaching object face 2, then the outer tubular portion 34 and the rock lever 18 are spaced away from each other along the center shaft 14 by the coil spring 20 (refer to FIG. 3), and consequently, the projections 1816 are displaced from the cams 42. Then, the rock lever 18 is turned back from the rocked position toward the initial position by the biasing force of the coil spring 20 until it is returned to the initial position.

Accordingly, with the suction cup device 10, the finally attached state can be established by an operation of the rock lever 18, which is advantageous when it is tried to firmly attach the suction cup device 10 to the attaching object face 2.

Further, since the operation of the rock lever 18 is performed by rotating the rock lever 18 around the center shaft 14, the rock lever 18 can be operated to rock without assuring a great space. Accordingly, the suction cup device 10 can be attached advantageously in a narrow space.

Further, if the suction cup device 10 is removed from the attaching object face 2, then the rock lever 18 is automatically returned to the initial position. Consequently, the operability of the suction cup device 10 can be enhanced advantageously.

Further, although the intermediately attached state may be omitted otherwise, where the intermediately attached state is implemented using the coil spring 20 as in the embodiment described above, then the suction cup device 10 can be attached firmly to the attaching object face 2 advantageously by the finally attached state.

Further, with the suction cup device 10, the action of biasing the rock lever 18 from the rocked position to the initial position and the action of biasing the outer tubular portion 34 and the rock lever 18 in a direction away from each other along the center shaft 14 are implemented by the single coil spring 20. Therefore, reduction of the number of parts and simplification of the structure can be anticipated advantageously.

Now, the joint 50 is described.

Referring to FIGS. 14A to 16, the joint 50 includes a first clamping plate 52 of an elongated shape, a second clamping plate 54 of an elongated shape, and a single male screw member 56.

Referring now to FIGS. 14A to 15B, the first and second clamping plates 52 and 54 are formed such that the width thereof in a direction perpendicular to the longitudinal direction is uniform. In the present embodiment, the widths of the first and second clamping plates 52 and 54 are equal to each other, and the opposite ends of the first and second clamping plates 52 and 54 in the longitudinal direction are formed arcuately.

Figure 14A:
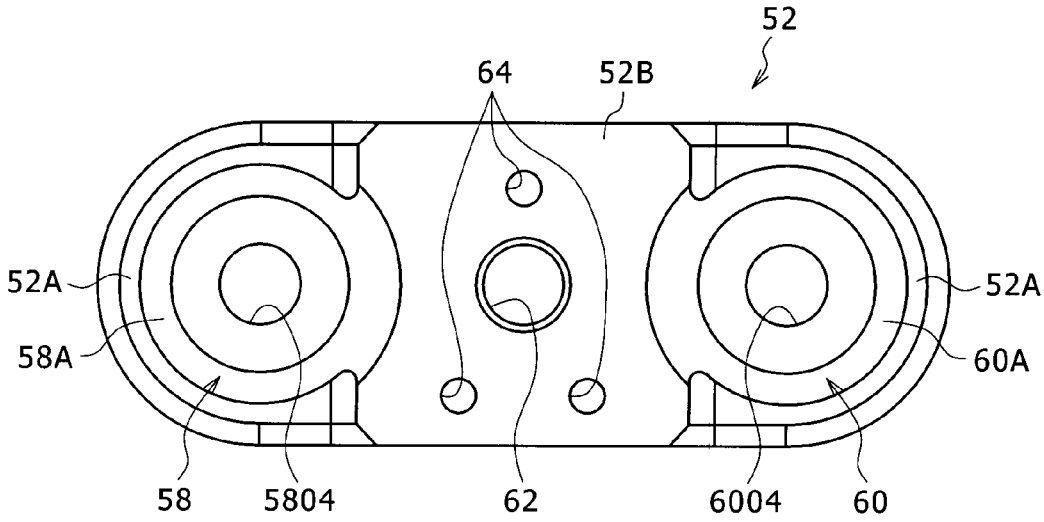
FIGS. 14A and 14B are a plan view and a front elevational view of a first clamping plate of the suction cup device.
Figure 14B:
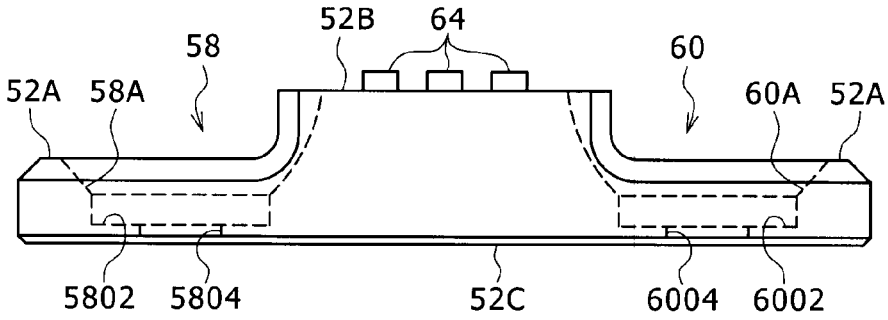

As seen in FIGS. 14A and 14B, a first clamping recessed portion 58 and a second clamping recessed portion 60 are formed at locations of an inner face of the first clamping plate 52 on the opposite sides in the longitudinal direction. Further, a fitting hole 62 is formed at a location of the first clamping plate 52 between the first and second clamping recessed portions 58 and 60 such that it allows insertion therethrough of the external thread of the external thread member 56.

Locations of the inner face of the first clamping plate 52 at the opposite sides in the longitudinal direction are formed as first inner faces 52A which extend on the same plane. Meanwhile, a location of the inner face of the first clamping plate 52 at a central portion in the longitudinal direction is formed as a second inner face 52B which projects from the first inner faces 52A and extends on a plane parallel to the plane of the first inner faces 52A.

Meanwhile, an outer face 52C which is the other face of the first clamping plate 52 in the thicknesswise direction is formed from a single flat face extending in parallel to the inner faces 52A and 52B.

The first clamping recessed portion 58 and the second clamping recessed portion 60 are formed on the first inner faces 52A while the fitting hole 62 is formed on the second inner face 52B.

The first clamping recessed portion 58 has a concave shape and has a first spherical clamping face 58A formed with the first radius over the overall circumference of a portion thereof which is open to the corresponding first inner face 52A.

In the present embodiment, a first recessed portion 5802 is formed at a depth greater than an imaginary extension plane of the first spherical clamping face 58A at the center of the first spherical clamping face 58A, and a hole 5804 is formed at the center of the first recessed portion 5802 such that it is open to the outer face 52C.

The second clamping recessed portion 60 has a concave shape and has a second spherical clamping face 60A formed with the second radius over the overall circumference of a portion thereof which is open to the first inner face 52A.

In the present embodiment, a second recessed portion 6002 is formed at a depth greater than an imaginary extension plane of the second spherical clamping face 60A at the center of the second spherical clamping face 60A, and a hole 6004 is formed at the center of the second recessed portion 6002 such that it is open to the outer face 52C.

The first and second radii are equal to each other as described above, and the fitting hole 62 is formed at the place of the center between the axis of the first clamping recessed portion 58 and the axis of the second clamping recessed portion 60.

A plurality of pins 64 for preventing turning motion of the first clamping plate 52 are provided in a projecting manner at different locations of the second inner face 52B around the fitting hole 62.

Figure 15A:
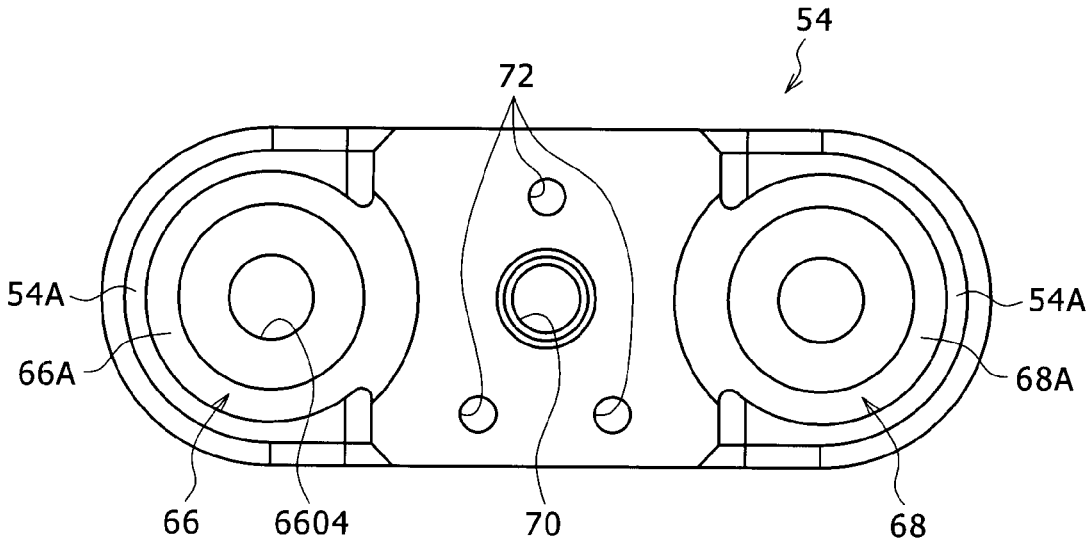
FIGS. 15A and 15B are a top plan view and a front elevational view, respectively, of a second clamping plate of the suction cup device.
Figure 15B:
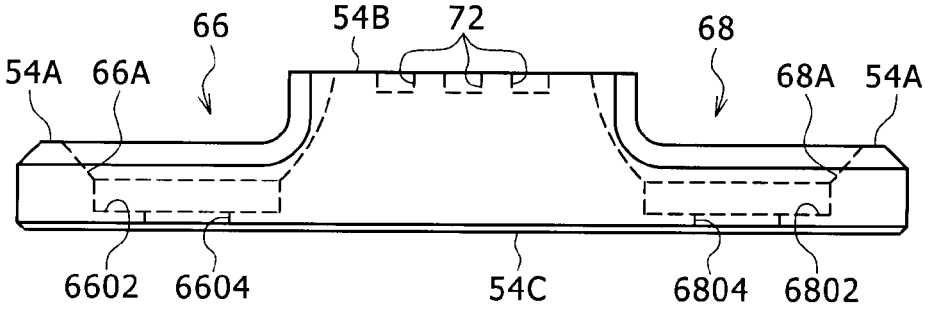

Referring now to FIGS. 15A and 15B, a third clamping recessed portion 66 and a fourth clamping recessed portion 68 are formed at locations of an inner face of the second clamping plate 54 on the opposite sides in the longitudinal direction. Further, an internal thread 70 is formed at a location between the third and fourth clamping recessed portions 66 and 68 for engaging with the external thread of the external thread member 56.

A pair of third inner faces 54A are formed at locations of the inner face of the second clamping plate 54 on the opposite sides in the longitudinal direction such that they extend on the same plane. Further, a location of the inner face at a central portion of the second clamping plate 54 in the longitudinal direction is formed as a fourth inner face 54B which projects from the third inner faces 54A and extends in a plane parallel to the plane of the third inner faces 54A.

Meanwhile, an outer face 54C which is the other face in the thicknesswise direction of the second clamping plate 54 is formed as a single face extending in parallel to the third and fourth internal faces 54A and 54B.

The third clamping recessed portion 66 and the fourth clamping recessed portion 68 are formed on the third internal faces 54A, and the internal thread 70 is formed at the fourth inner face 54B.

The third clamping recessed portion 66 has a third spherical clamping face 66A formed with the first radius over the overall circumference of a portion thereof opened to the corresponding third internal face 54A.

In the present embodiment, a third recessed portion 6602 is formed at a depth greater than that of an imaginary extension plane of the third spherical clamping face 66A at the center of the third spherical clamping face 66A, and a hole 6604 is formed at the center of the third recessed portion 6602 such that it is opened to the outer face 54C.

The fourth clamping recessed portion 68 has a concave shape and has a fourth spherical clamping face 68A formed with the second radius over the overall circumference of a portion thereof opened to the corresponding third internal face 54A.

In the present embodiment, a fourth recessed portion 6802 is formed at a depth greater than that of an imaginary extension plane of the fourth spherical clamping face 68A at the center of the fourth spherical clamping face 68A, and a hole 6804 is formed at the center of the fourth recessed portion 6802 such that it is open to the outer face 54C.

The internal thread 70 is formed such that it is engaged with the external thread of the external thread member 56 fitted in the fitting hole 62 in a state wherein the axes of the first clamping recessed portion 58 and the third clamping recessed portion 66 are aligned with each other and the axes of the second clamping recessed portion 60 and the fourth clamping recessed portion 68 are aligned with each other.

As described above, the first and second radii have an equal dimension, and the internal thread 70 is formed at the location of the center between the axis of the third clamping recessed portion 66 and the axis of the fourth clamping recessed portion 68.

A plurality of engaging holes 72 are formed at different locations of the fourth inner face 54B around the internal thread 70 for engaging with the turning motion preventing pins 64.

Figure 16:
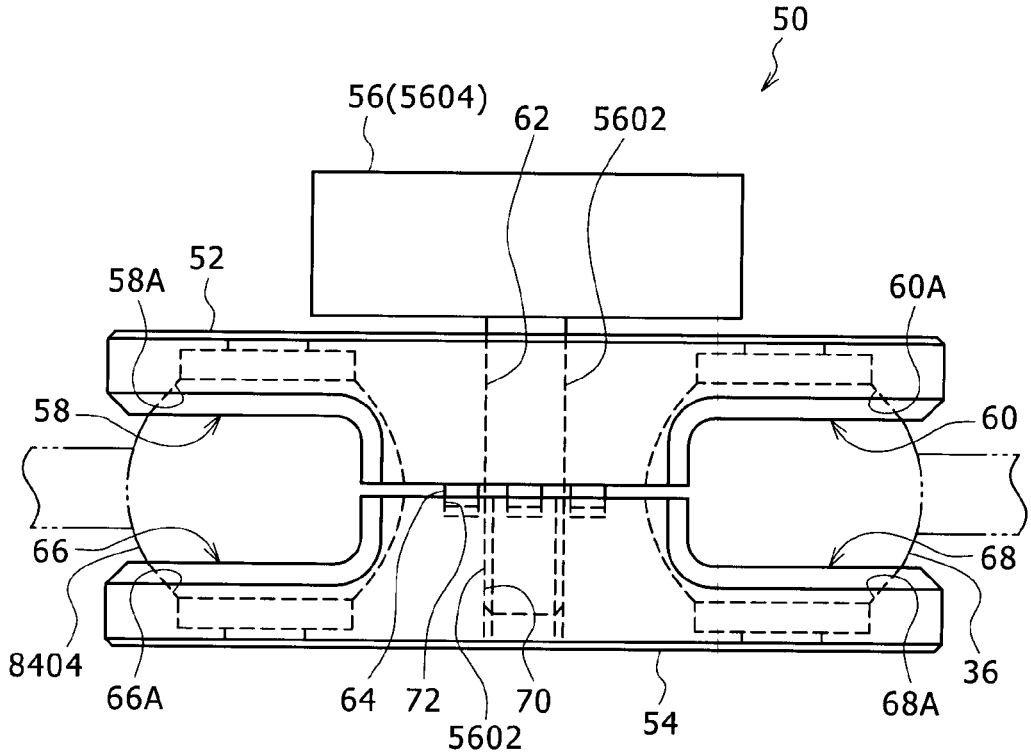
FIG. 16 is a view of a joint of the suction cup device in an assembled form.

Referring now to FIG. 16, the external thread member 56 has an external thread 5602 and a head portion 5604.

Referring to FIG. 16, in the joint 50, the first clamping recessed portion 58 and the third clamping recessed portion 66 are opposed to each other, and the second clamping recessed portion 60 and the fourth clamping recessed portion 68 are opposed to each other. Further, the first spherical member 8404 is positioned between the first clamping recessed portion 58 and the third clamping recessed portion 66, and the second spherical member 36 is positioned between the second clamping recessed portion 60 and the fourth clamping recessed portion 68.

Then, the head portion 5604 is operated to tighten the external thread 5602 of the external thread member 56 fitted in the fitting hole 62 into the internal thread 70. Consequently, the first spherical member 8404 is clamped between and fixed by the first spherical clamping face 58A and the third spherical clamping face 66A, and the second spherical member 36 is clamped between and fixed by the second spherical clamping face 60A and the fourth spherical clamping face 68A as seen in FIG. 16. Consequently, the suction cup device 10 and the music piece receiving frame 82 are connected to each other through the connector 84 and the joint 50 as seen in FIG. 1.

It is to be noted that, in the tightened fixed state described, a gap is assured between the second inner face 52B of the first clamping plate 52 and the fourth inner face 54B of the second clamping plate 54, and the inner faces 52B and 54B extend in parallel to each other.

With the joint 50 of the present embodiment, before the first and second spherical members 8404 and 36 are clamped and fixed, the first spherical member 8404 can be rotated in a desired direction between the first spherical clamping face 58A and the third spherical clamping face 66A. Further, the second spherical member 36 can be rotated in a desired direction between the second spherical clamping face 60A and the fourth spherical clamping face 68A. In other words, the music paper receiving frame 82 can be attached in a desired posture with respect to the suction cup device 10 with certainty by means of the two first and second spherical members 8404 and 36.

In other words, the music paper receiving frame 82 is supported by the suction cup device 10 and the joint 50 such that the posture thereof can be changed.

Further, since the first spherical member 8404 is clamped between and fixed by the first spherical clamping face 58A and the third spherical clamping face 66A both having a radius equal to that of the first spherical member 8404 and the second spherical member 36 is clamped between and fixed by the second spherical clamping face 60A and the fourth spherical clamping face 68A both having a radius equal to that of the second spherical member 36, clamped fixation of the first and second spherical members 8404 and 36 is performed with certainty.

Accordingly, the music paper receiving frame 82 and the suction cup device 10 are connected to each other in a desired posture with certainty. More particularly, a high degree of freedom can be assured in change of the posture of the music paper receiving frame 82 with respect to the attaching object face 2, and the music paper receiving frame 82 can be attached in a desired posture.

Further, with the joint 50 of the present embodiment, both of the first and second spherical members 8404 and 36 can be simultaneously placed into a state wherein they can turn freely or into another state wherein they are clamped and fixed simultaneously by a simple operation of loosening or tightening the external thread member 56. Therefore, changing of the posture of the music paper receiving frame 82 can be performed rapidly, which is advantageous in enhancement of the operability.

Further, with the joint 50 of the present embodiment, the first and second spherical members 8404 and 36 are formed with an equal radius and the fitting hole 62 is formed at a location of the center between the axis of the first clamping recessed portion 58 and the axis of the second clamping recessed portion 60, and besides the internal thread 70 is formed at a location of the center between the axis of the third clamping recessed portion 66 and axis of the fourth clamping recessed portion 68. Therefore, the force of clamping the first spherical member 8404 between the first and third spherical clamping faces 58A and 66A and the force of clamping the second spherical member 36 between the second and fourth spherical clamping faces 60A and 68A by tightening the external thread member 56 can be made equal to each other. Consequently, the first and second spherical members 8404 and 36 can be clamped and fixed advantageously with certainty.

It is to be noted that, although the first and second spherical members 8404 and 36 may have different radii from each other and the location of the external thread member 56 may be displaced from the position of the center between the axis of the first clamping recessed portion 58 and the axis of the second clamping recessed portion 60, where such a configuration as is used in the present embodiment is applied, the structure for making the forces of clamping the first and second spherical members 8404 and 36 equal to each other can be simplified. This is advantageous in achievement of reduction of the production cost.

With the music stand 80 of the present embodiment, since the music paper receiving frame 82 can be attached to the attaching object face 2 using the suction cup device 10, different from music stands of the past, the music stand 80 can be installed making use of the attaching object face 2 of a small area corresponding to the suction cup 12 such as the surface of a musical instrument such as a piano or a keyboard or the surface of a table without placing the music stand 80 on the floor.

Further, since the music paper receiving frame 82 is supported on the attaching object face 2 by the suction cup device 10 and the suction cup 12 has high attractive force to the attaching object face 2, even if some person collides with the music paper receiving frame 82, the music paper receiving frame 82 does not fall. This is advantageous in enhancement of the convenience in use.

Now, a first reference example is described.

The first reference example relates to a screen apparatus.

A screen apparatus which displays an image projected from a projector apparatus or the like is known and disclosed, for example, in Japanese Patent Laid-Open No. Hei 7-209750, Japanese Patent Laid-Open No. 2006-154854 or Japanese Patent Laid-Open No. 2006-299611.

A screen apparatus of the type described includes a screen on which an image is to be displayed, and an unwinding-winding mechanism for supporting the screen such that it can be unwound and wound.

In such a screen apparatus of the past as just described, suspending devices such as hooks are attached to a wall, and a frame of the unwinding-winding mechanism is suspended on the suspending device such that the screen is spread.

However, such a screen apparatus of the past as just described has a disadvantage that, also when the screen apparatus is not used, the suspending devices remain on the wall and spoil the aesthetic appearance of the room.

The first reference example provides a screen apparatus which eliminates such a disadvantage as just described but advantageously improves the aesthetic appearance of the room in that, when the screen apparatus is not used, such suspending devices as in the apparatus of the past do not remain on the wall.

The screen apparatus of the first reference example includes an unwinding-winding mechanism for supporting a screen so as to be unwound and wound, and a pair of suction cup devices, each of the suction cup devices including a suction cup having a suction face and a rear face on the opposite sides along a thicknesswise direction thereof, a center shaft provided at the center of the rear face of the suction cup and extending in a direction away from the rear face along the thicknesswise direction, an attaching base having a skirt portion configured to cover the rear face of the suction cup and an outer tubular portion projecting from the center of the skirt portion and having the center shaft accommodated therein, and a displacement mechanism provided between the center shaft and the attaching base and configured to bias the center shaft and the attaching base in a direction in which, in a state wherein the suction face is attached to an attaching object face, an end of the skirt portion is pressed against the rear face of the suction cup or the end of the skirt portion is pressed against a portion of the attaching object face positioned on the outer side of the suction cup and displace the center shaft in a direction in which the center shaft is spaced away from the attaching object face, the outer tubular portions of the two suction cup devices being removably connected to the opposite sides of the unwinding-winding mechanism.

Figure 17:
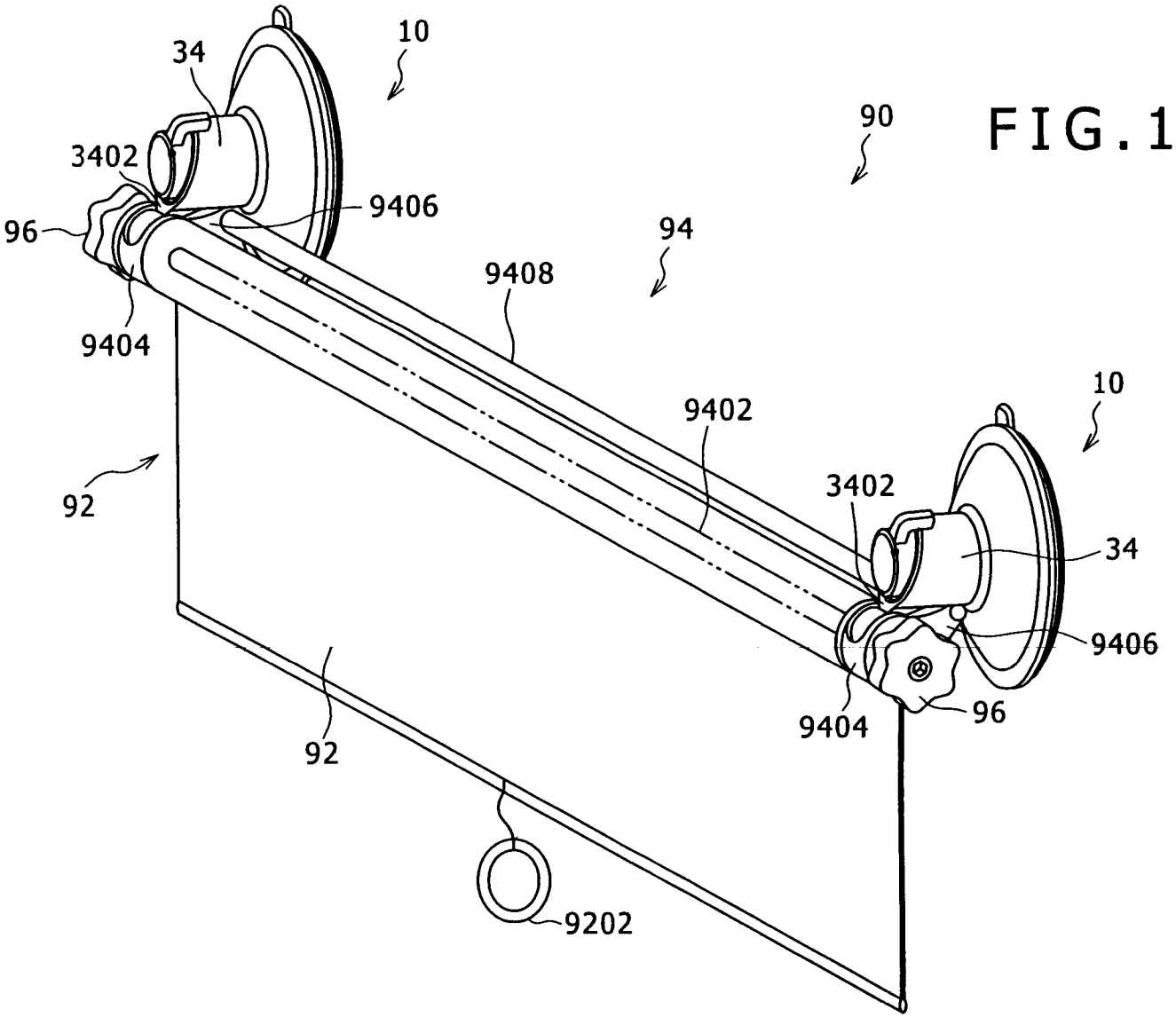
FIG. 17 is a perspective view of a screen apparatus of the first reference example.

FIG. 17 shows a screen apparatus 90 of the first reference example.

Referring to FIG. 17, the screen apparatus 90 includes a screen 92 on which an image is to be displayed, an unwinding-winding mechanism 94 for supporting the screen 92 so as to be unwound and wound, and a pair of suction cup devices 10.

The unwinding-winding mechanism 94 includes a takeup shaft 9402 on which the screen 92 is wrapped. If the screen 92 is unwound from the unwinding-winding mechanism 94, then it is stopped and spread at the position, and then if the screen 92 is unwound a little again, then it is wound by the takeup shaft 9402. For such a configuration of the unwinding-winding mechanism 94 including the screen 92 as just described, various known structures can be adopted.

In the present first reference example, a pair of projections 9406 are provided in a projecting manner on frames 9404 provided on the opposite sides of the unwinding-winding mechanism 94. The projections 9406 are connected to each other by a rod 9408 so as to provide a firm structure to the frames 9404 of the unwinding-winding mechanism 94.

The suction cup devices 10 have a configuration similar to that described hereinabove, and therefore, overlapping description thereof is omitted herein to avoid redundancy.

The suction cup devices 10 are connected to the unwinding-winding mechanism 94.

In particular, a flange 3402 is provided in a projecting manner on the outer tubular portion 34 of each suction cup device 10. The flanges 3402 of the outer tubular portions 34 are removably attached to end faces of the frames 9404 on the opposite sides of the unwinding-winding mechanism 94 by means of external screw members 96 thereby to support the unwinding-winding mechanism 94 by means of the suction cup devices 10.

With the first reference example, the screen apparatus 90 can be attached to and removed from the attaching object face 2, which may be a wall, using the suction cup devices 10.

Accordingly, when the screen apparatus 90 is not used, such suspending devices as in the apparatus of the past do not remain on the wall, and this is advantageous when it is tried to improve the aesthetic appearance of the room.

Further, since the suction cup devices 10 are attached to the attaching object face 2 such as a wall, when the screen apparatus 90 is to be used, it is possible to set the location of the screen 92 to a desired location every time. This is advantageous in improvement in convenience in use.

Now, a second reference example is described.

The second reference example relates to a speaker apparatus.

A speaker apparatus for use with an audio system is known which includes a speaker body wherein a speaker unit for generating sound is incorporated in an enclosure, and a stand attached to the enclosure. A speaker apparatus of the type described is disclosed, for example, in Japanese Patent Laid-Open No. 2006-287894.

Such a speaker apparatus as just described is in most cases used such that a stand thereof is placed on a desk or a shelf.

However, such a speaker apparatus of the past as described above is disadvantageous in that, since the stand thereof is placed on a desk, a shelf or the like, it is liable to fall down when it is hit by something, and since it is necessary for the stand to be placed on a desk, a shelf or the like, the location of the speaker apparatus is restricted to a flat place directed upwardly.

The second reference example provides a screen apparatus which eliminates such a disadvantage as described above and is advantageous where it is tried to assure a high degree of freedom in the location of the speaker apparatus.

To this end, the speaker apparatus of the second reference example includes a speaker body and a suction cup device, the suction cup device including a suction cup having a suction face and a rear face on the opposite sides along a thicknesswise direction thereof, a center shaft provided at the center of the rear face of the suction cup and extending in a direction away from the rear face along the thicknesswise direction, an attaching base having a skirt portion configured to cover the rear face of the suction cup and an outer tubular portion projecting from the center of the skirt portion and having the center shaft accommodated therein, and a displacement mechanism provided between the center shaft and the attaching base and configured to bias the center shaft and the attaching base in a direction in which, in a state wherein the suction face is attached to an attaching object face, an end of the skirt portion is pressed against the rear face of the suction cup or the end of the skirt portion is pressed against a portion of the attaching object face positioned on the outer side of the suction cup and displace the center shaft in a direction in which the center shaft is spaced away from the attaching object face, the speaker body and the outer tubular portion being removably connected to each other.

Figure 18:
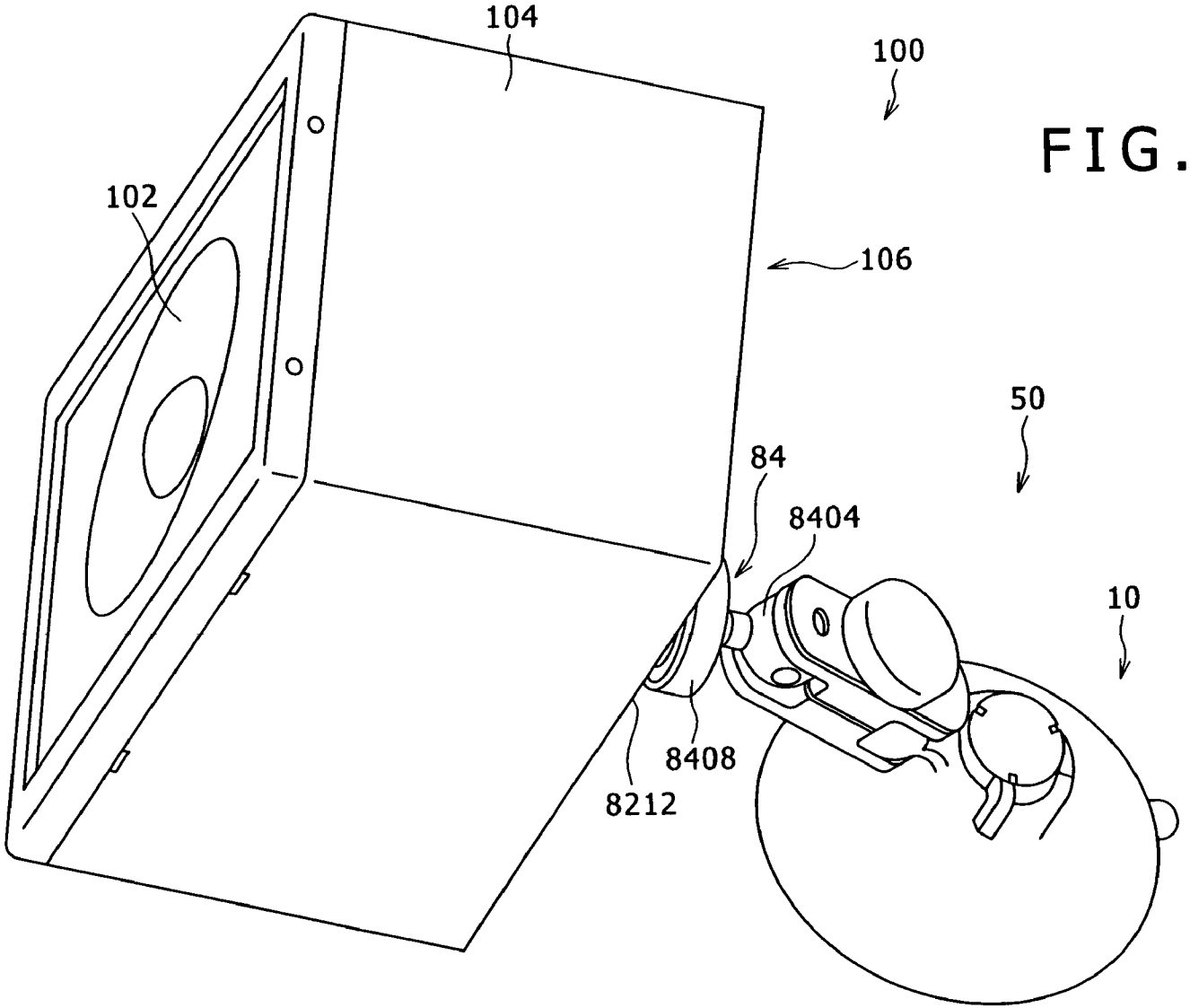
FIG. 18 is a perspective view of a speaker apparatus of the second reference example.

FIG. 18 shows a speaker apparatus 100 of the second reference example.

Referring to FIG. 18, the speaker apparatus 100 shown includes a speaker body 106 which includes a speaker unit 102 for generating sound and an enclosure 104 in which the speaker unit 102 is incorporated, a suction cup device 10, and a joint 50.

An engaging groove 8212 (refer to FIG. 1) similar to that shown in FIG. 1 is provided at a lower portion of the rear face of the speaker body 106 (enclosure 104), and the connector 84 is removably attached to the engaging groove 8212.

The connector 84 is attached to the rear face of the speaker body 106 such that the engaging plate 8406 (refer to FIG. 2) is inserted into the engaging groove 8212 and the nut 8408 is tightened.

Then, the suction cup device 10 and the speaker body 106 are connected to each other through the connector 84 and the joint 50.

The connector 84, suction cup device 10 and joint 50 are configured similarly to those described hereinabove, and overlapping description thereof is omitted hereinto avoid redundancy.

With the second reference example, the attracting force of the suction cup 12 to the attaching object face 2 is so high that there is no possibility that the speaker body 106 may fall.

Further, the speaker body 106 can be installed not only at a flat place directed upwardly such as a desk or a shelf but also at a ceiling face directed downwardly or a wall face directed horizontally using the suction cup device 10. This is advantageous when it is tried to assure a high degree of freedom in determination of the location of the speaker apparatus 100.

Now, a third reference example is described.

The third reference example relates to an attaching apparatus for a camera.

A tripod to which a camera such as a digital still camera or a video camera is attached when it is used is known and disclosed, for example, in Japanese Patent Laid-Open No. 2004-271867.

Such a tripod as just described includes a pan head having a fastening screw for being screwed into a tripod attaching internal thread of a camera, a bracket for supporting the pan head, and three legs attached to the bracket and extending radially. The tripod is used such that the legs are placed on a flat place directed upwardly such as the floor.

However, such a tripod as just described is disadvantageous in that, since it is placed on a flat place, it is liable to fall down when it is hit by something, and since the location of the camera is restricted to a flat place directed upwardly, the degree of freedom in the location of the camera is low.

The third reference example provides an attaching apparatus for a camera which eliminates such a disadvantage as described above and is advantageous when it is tried to assure a high degree of freedom in determination of the location of a camera.

The attaching apparatus for a camera of the third working example includes a suction cup device which in turn includes a suction cup having a suction face and a rear face on the opposite sides along a thicknesswise direction thereof, a center shaft provided at the center of the rear face of the suction cup and extending in a direction away from the rear face along the thicknesswise direction, an attaching base having a skirt portion configured to cover the rear face of the suction cup and an outer tubular portion projecting from the center of the skirt portion and having the center shaft accommodated therein, and a displacement mechanism provided between the center shaft and the attaching base and configured to bias the center shaft and the attaching base in a direction in which, in a state wherein the suction face is attached to an attaching object face, an end of the skirt portion is pressed against the rear face of the suction cup or the end of the skirt portion is pressed against a portion of the attaching object face positioned on the outer side of the suction cup and displace the center shaft in a direction in which the center shaft is spaced away from the attaching object face, a connection portion which can be connected to an image pickup apparatus being provided on the outer tubular portion.

Figure 19:
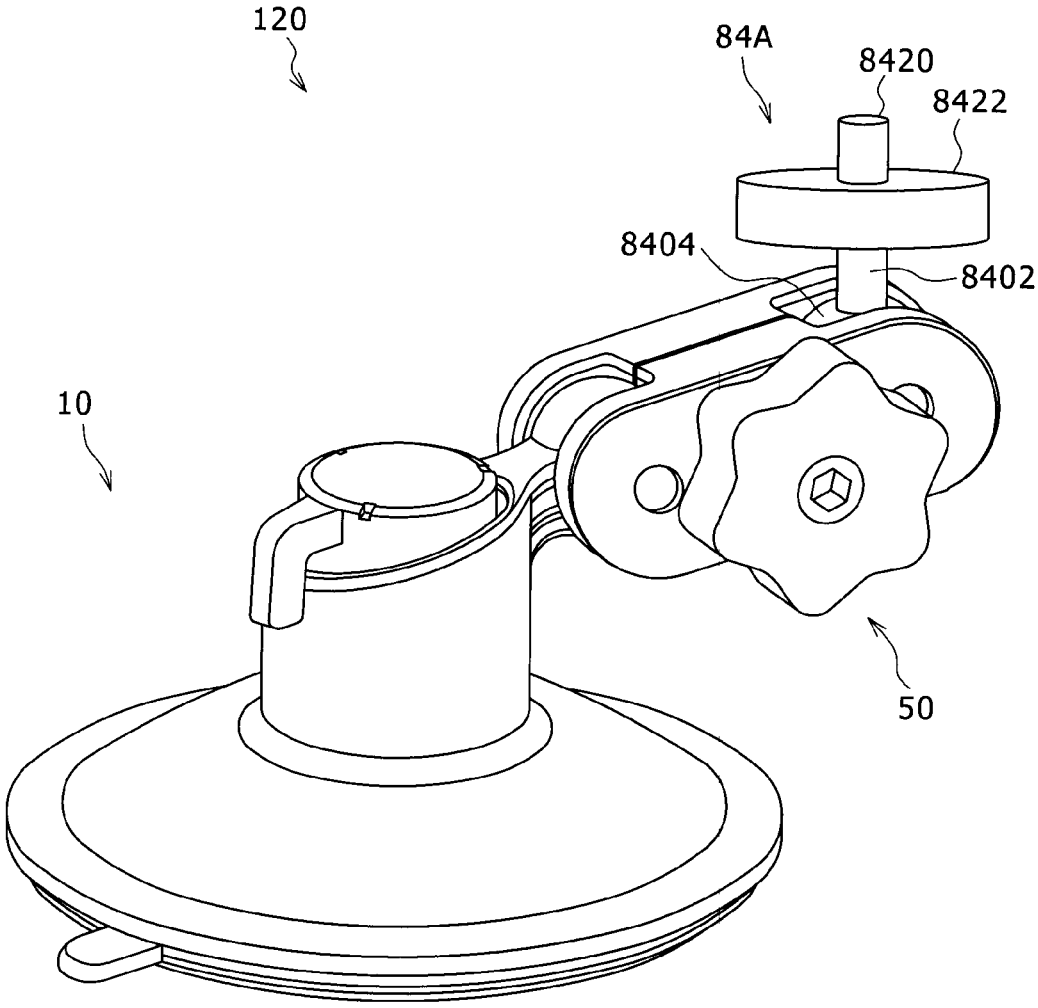
FIG. 19 is a perspective view of an attaching apparatus of the third reference example.

FIG. 19 shows an attaching apparatus 120 for a camera of the third reference example, and FIGS. 20 to 23 show the attaching apparatus 120 for a camera in a used state wherein a camera is attached thereto.

Referring to FIG. 19, the attaching apparatus 120 for a camera includes a suction cup device 10, a joint 50, and a connector 84A.

Figure 20:
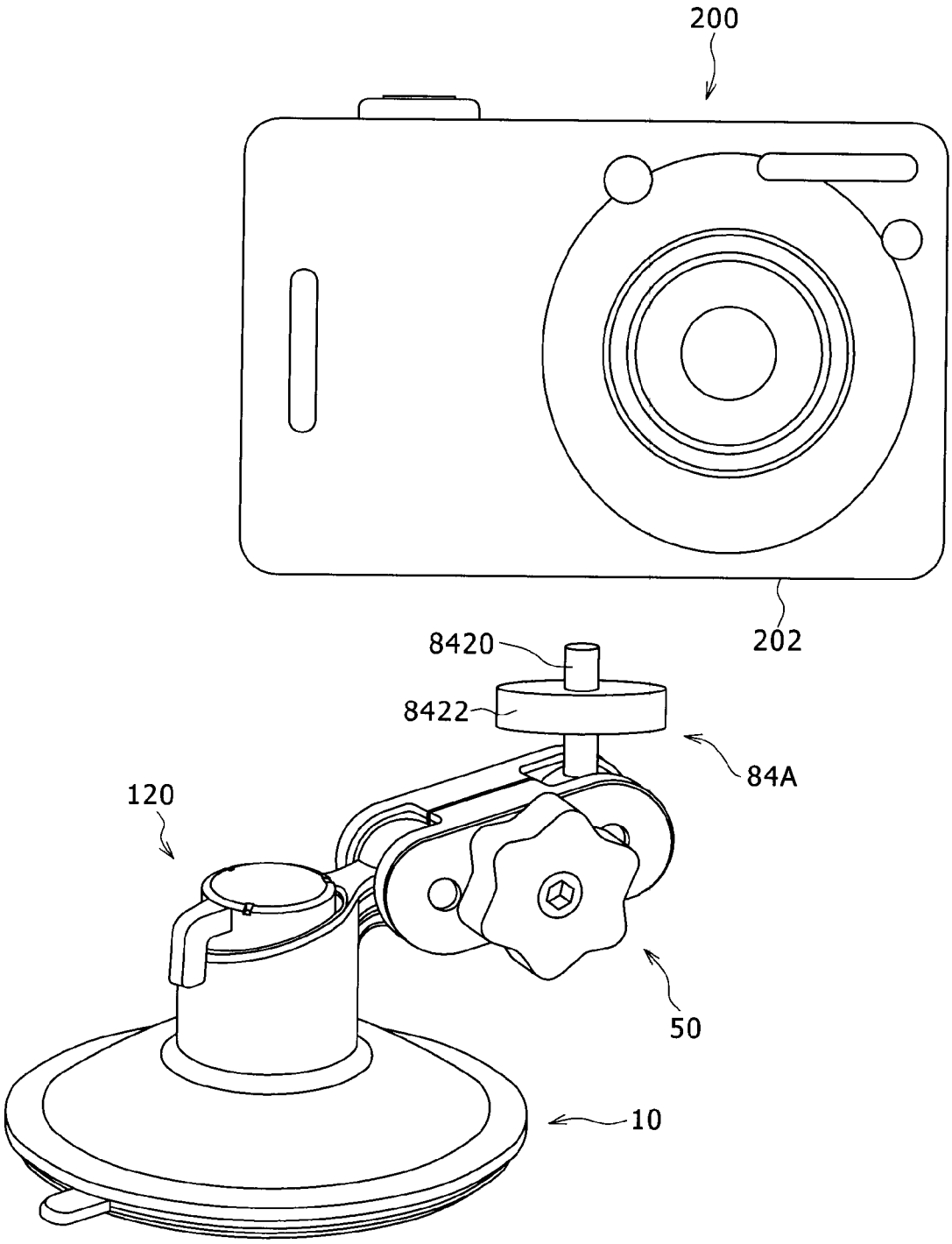
FIG. 20 is a schematic perspective view showing a digital still camera attached to a camera attaching apparatus using the suction cup device.
Figure 23:
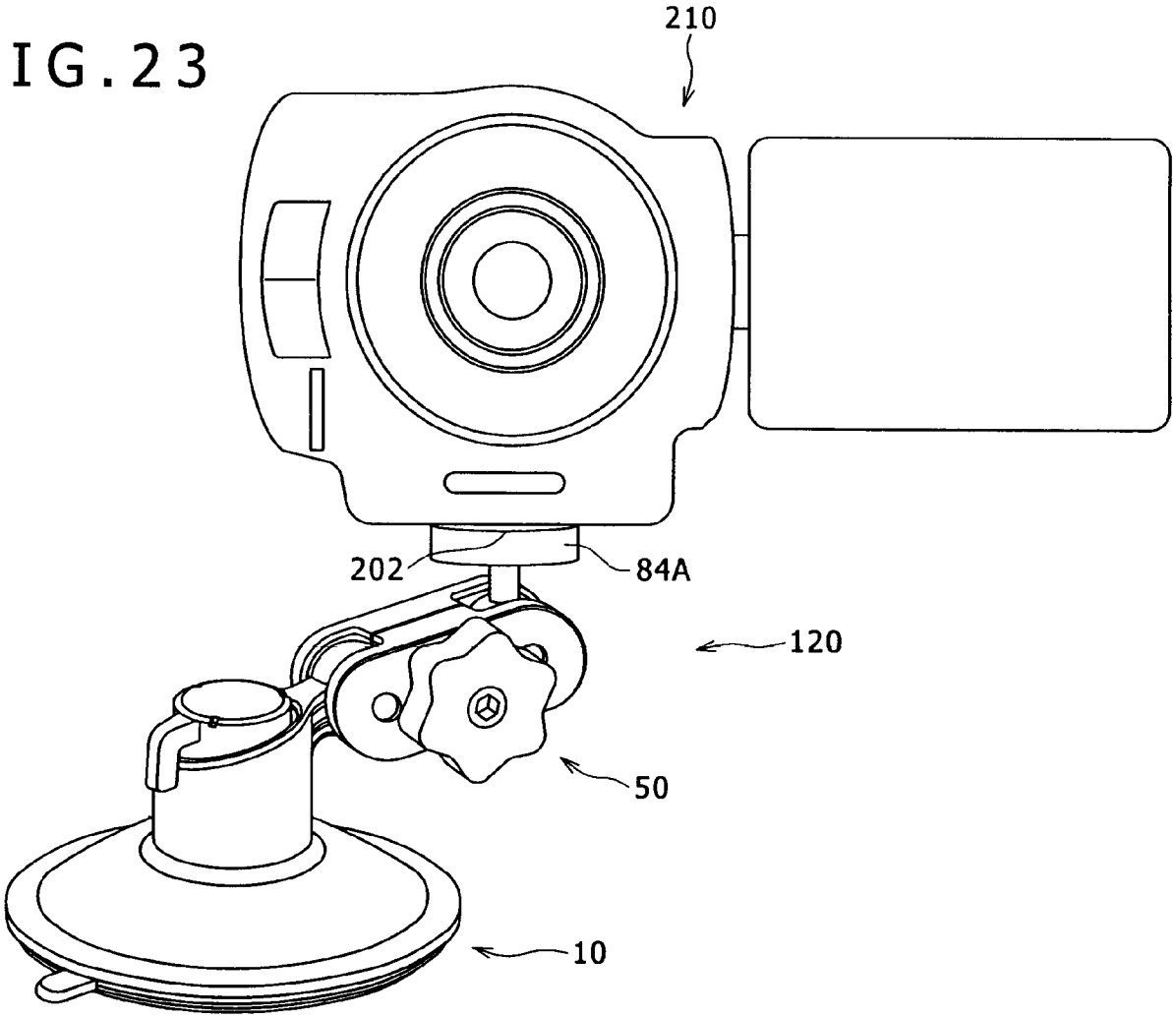
FIG. 23 is a schematic perspective view showing a video camera in a used state wherein the video camera is attached to the camera attaching apparatus using the suction cup device.

The connector 84A includes a stem portion 8402 similar to the connector 84 described hereinabove with reference to FIG. 2, and a first spherical body 8404 provided at one end of the stem portion 8402. At the other end of the stem portion 8402, an external screw 8420 (in the present example, this external screw 8420 corresponds to a connection portion which can be connected to an image pickup apparatus) is formed. The external screw 8420 is formed so as to be screwed into a tripod attaching internal screw 202 formed on such a digital still camera 200 as shown in FIG. 20 or on such a video camera 210 as seen in FIG. 23. An abutting plate 8422 in the form of a disk is formed integrally at an intermediate portion of the stem portion 8402.

Accordingly, if the external screw 8420 of the connector 84A is screwed into the tripod attaching internal screw 202 of the digital still camera 200 or the video camera 210 until the abutting plate 8422 is abutted with the bottom face of the digital still camera 200 or the video camera 210, then the connector 84A and the digital still camera 200 or the video camera 210 are connected to each other. Consequently, the digital still camera 200 or the video camera 210 is supported by the suction cup device 10 through the joint 50.

It is to be noted that the suction cup device 10 and the joint 50 are similar to those described hereinabove, and therefore, overlapping description of them is omitted herein to avoid redundancy.

With the third reference example, the attractive force of the suction cup 12 to the attaching object face 2 is so high that there is no possibility that the digital still camera 200 or the video camera 210 may fall down.

Further, a camera such as the digital still camera 200 or the video camera 210 can be installed not only at a flat place directed upwardly such as the floor but also at a ceiling face directed downwardly or a wall face, window glass or an outer wall directed horizontally using the suction cup device 10. In this manner, a camera can be installed at any place only if it has a flat face. This is advantageous when it is tried to assure a high degree of freedom in determination of the location of the camera.

Figure 21:
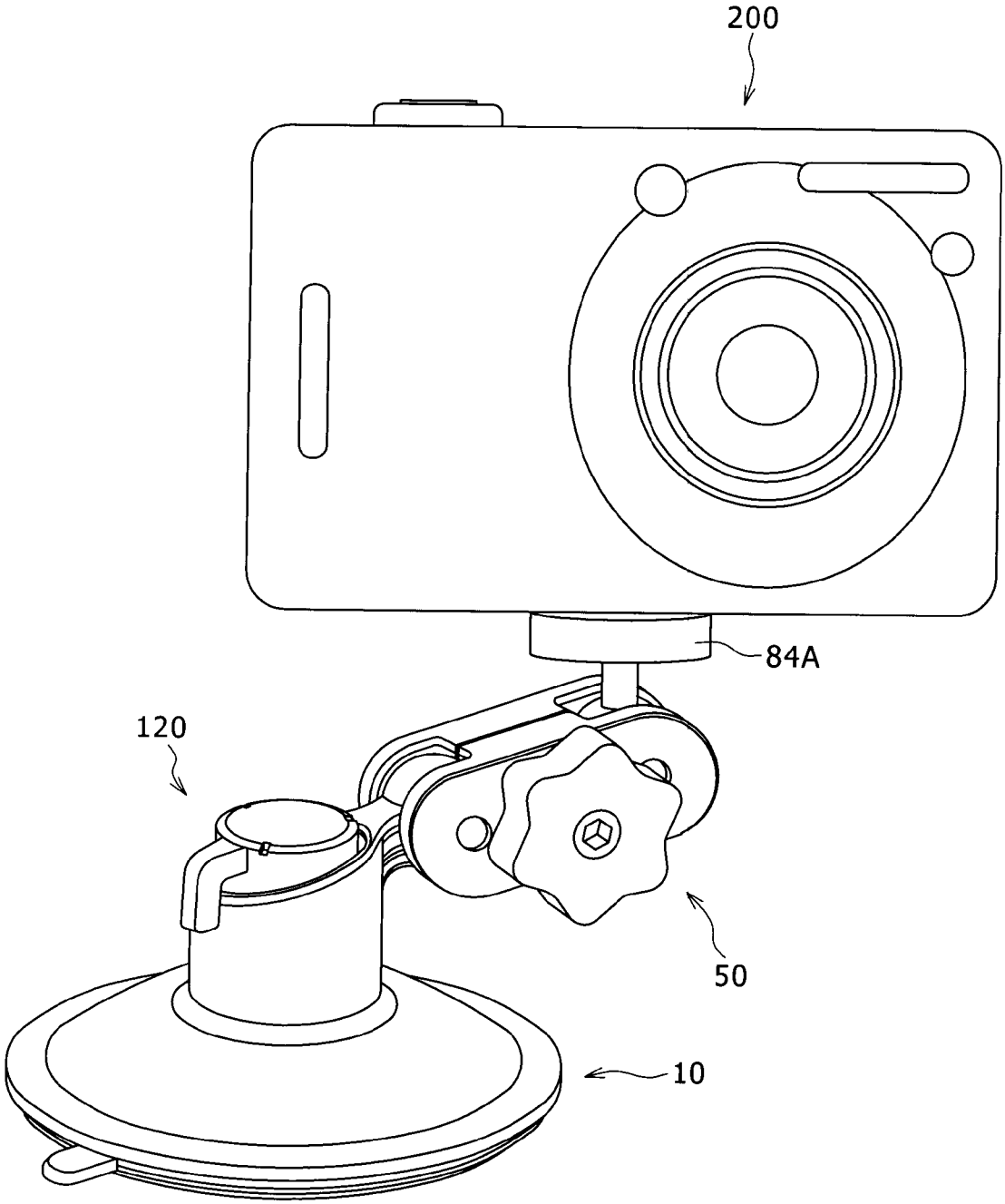
FIGS. 21 and 22 are schematic perspective views showing the digital still camera in a used state wherein the digital still camera is attached to the camera attaching apparatus.
Figure 22:
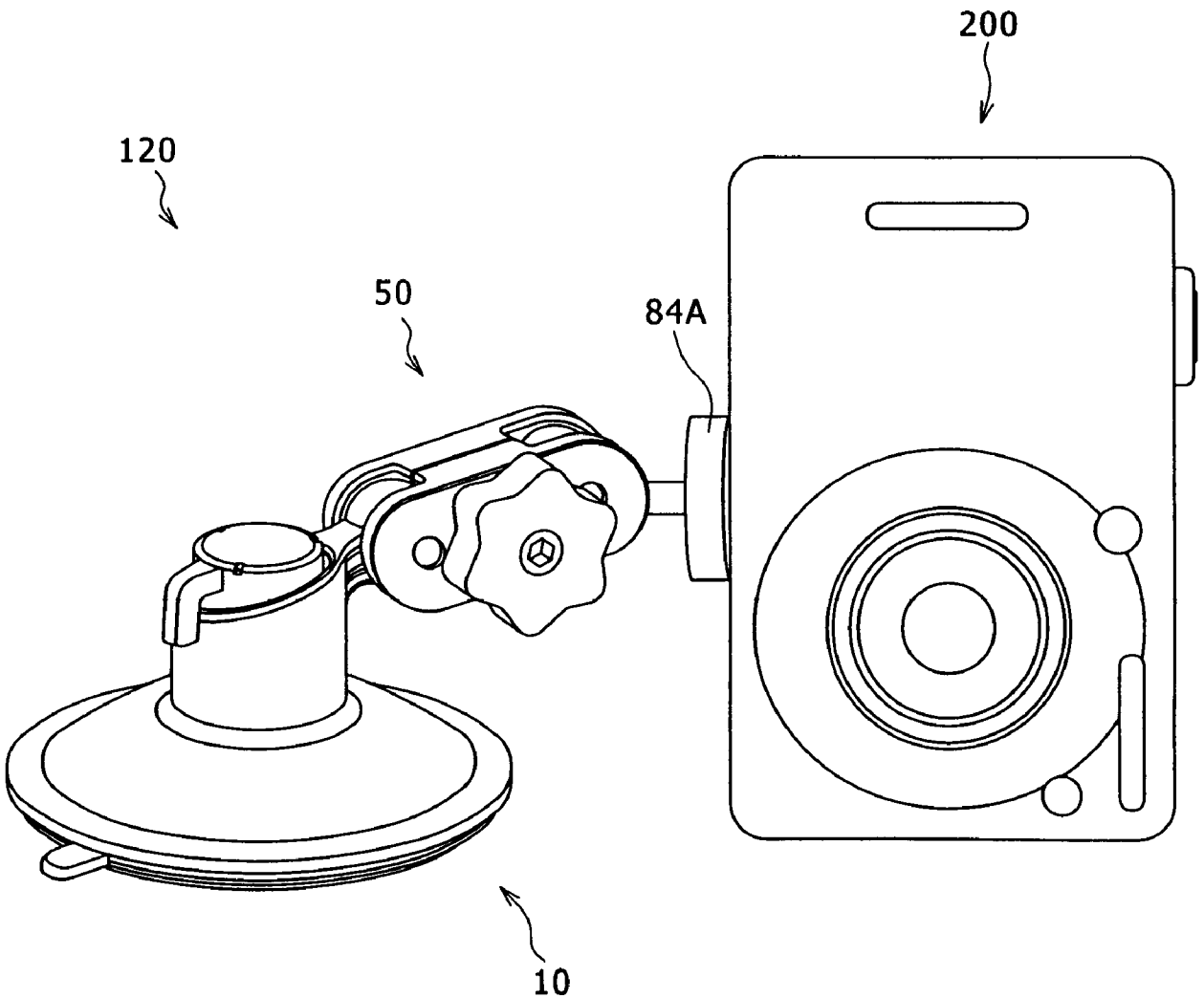

Further, since the attracting force of the suction cup 12 to the attaching object face 2 is high, a camera can be supported such that it can assume various horizontal and vertical postures as seen in FIGS. 21 and 22 and therefore the image pickup angle can be varied flexibly. This is advantageous when it is tried to improve the convenience in use upon image pickup.

While attaching apparatus for a music stand, a screen apparatus, a speaker apparatus and a camera are described are described as typical apparatus to which the present invention is applied, the article to be retained by the attaching apparatus according to the present invention is not limited to those described above. In short, the present invention can be embodied as an article retaining apparatus which can retain an article with certainty using a suction cup having high attracting force to an attaching object face. In particular, the present invention provides an article retaining apparatus including an article retaining section configured to support an article rested thereon, and a suction cup device configured to support the article retaining section, the suction cup device including a suction cup having a suction face and a rear face on the opposite sides along a thicknesswise direction thereof, a center shaft provided at the center of the rear face of the suction cup and extending in a direction away from the rear face along the thicknesswise direction, an attaching base having a skirt portion configured to cover the rear face of the suction cup and an outer tubular portion projecting from the center of the skirt portion and having the center shaft accommodated therein, and a displacement mechanism provided between the center shaft and the attaching base and configured to bias the center shaft and the attaching base in a direction in which, in a state wherein the suction face is attached to an attaching object face, an end of the skirt portion is pressed against the rear face of the suction cup or the end of the skirt portion is pressed against a portion of the attaching object face positioned on the outer side of the suction cup and displace the center shaft in a direction in which the center shaft is spaced away from the attaching object face, the article retaining section and the outer tubular portion being connected to each other.

It should be understood by those skilled in the art that various modifications, combinations, sub-combinations and alterations may occur depending on design requirements and other factors insofar as they are within the scope of the appended claims or the equivalents thereof.

What is claimed is:

1. A music stand, comprising:

a music paper receiving frame configured to support music paper rested thereon; and a suction cup device configured to support said music paper receiving frame, said suction cup device including a suction cup having a suction face and a rear face on the opposite sides along a thicknesswise direction thereof, a center shaft provided at the center of said rear face of said suction cup and extending in a direction away from said rear face along the thicknesswise direction, an attaching base having a skirt portion configured to cover said rear face of said suction cup and an outer tubular portion projecting from the center of said skirt portion and having said center shaft accommodated therein, and a displacement mechanism provided between said center shaft and said attaching base and configured to bias said center shaft and said attaching base in a direction in which, in a state wherein said suction face is attached to an attaching object face, an end of said skirt portion is pressed against said rear face of said suction cup or the end of said skirt portion is pressed against a portion of the attaching object face positioned on the outer side of said suction cup and displaces said center shaft in a direction in which said center shaft is spaced away from the attaching object face, said displacement mechanism including a lock lever coupled to an end portion of said center shaft against movement in an axial direction of said center shaft but for rotation in a circumferential direction of said center shaft between an initial position and a locked position, a coil spring disposed around said center shaft on the inner side of said outer tubular portion and anchored at one end thereof by said outer tubular portion and at the other end thereof by said lock lever in such a manner as to bias said lock lever toward the initial position and bias said outer tubular portion and said lock lever in a direction away from each other along said center shaft, and a cam mechanism provided between said outer tubular portion and said lock lever and configured to move, in response to the rotation of said lock lever from the initial position to the locked position, said suction cup from an initially attached state which is established by pressing, with said suction face opposed to the attaching object face, said center shaft against the attaching object face until said suction face is contacted over an overall area thereof with the attaching object face and the end portion of said skirt portion is contacted with an outer circumferential portion of said rear face or with a portion of the attaching object face on the outer side in a radial direction of said rear face to a finally attached state wherein said center shaft is displaced in a direction away from the attaching object face and then retain said lock lever at the locked position against the biasing force of said coil spring, wherein said music paper receiving frame and said outer tubular portion are connected to each other.

2. The music stand according to claim 1, wherein said music paper receiving frame and said outer tubular portion are connected to each other though a joint.

3. The music stand according to claim 1, wherein said suction cup includes a suction cup body and a gel layer;

said suction cup body being formed from a resilient material while forming said rear face;

said gel layer being formed from gel and attached to said suction cup body to form said suction face.

4. The music stand according to claim 1, wherein said suction cup further has an intermediately attached state wherein said center shaft is displaced in the direction away from the attaching object face by said coil spring from the position thereof when said suction cup is in the initially attached state; and the finally attached state is established by rotating, while said suction cup is in the intermediately attached state, said lock lever from the initial position to the locked position to further displace said center shaft in the direction away from the attaching object face.

5. The music stand according to claim 1, wherein said lock lever has an inner tubular portion inserted between the outer circumference of said center shaft and the inner circumference of said outer tubular portion and coupled to said center shaft against movement in the axial direction of said center shaft but for rotation around said center shaft, and a lever portion for rotating operation projecting outwardly in a radial direction of said inner tubular portion from said inner tubular portion, and said cam mechanism is provided between the inner circumference of said outer tubular portion and said inner tubular portion.

6. An article retaining apparatus, comprising:

an article retaining section configured to support an article rested thereon; and a suction cup device configured to support said article retaining section, said suction cup device including a suction cup having a suction face and a rear face on the opposite sides along a thicknesswise direction thereof, a center shaft provided at the center of said rear face of said suction cup and extending in a direction away from said rear face along the thicknesswise direction, an attaching base having a skirt portion configured to cover said rear face of said suction cup and an outer tubular portion projecting from the center of said skirt portion and having said center shaft accommodated therein; and a displacement mechanism provided between said center shaft and said attaching base and configured to bias said center shaft and said attaching base in a direction in which, in a state wherein said suction face is attached to an attaching object face, an end of said skirt portion is pressed against said rear face of said suction cup or the end of said skirt portion is pressed against a portion of the attaching object face positioned on the outer side of said suction cup and displaces said center shaft in a direction in which said center shaft is spaced away from the attaching object face, said displacement mechanism including a lock lever coupled to an end portion of said center shaft against movement in an axial direction of said center shaft but for rotation in a circumferential direction of said center shaft between an initial position and a locked position, a coil spring disposed around said center shaft on the inner side of said outer tubular portion and anchored at one end thereof by said outer tubular portion and at the other end thereof by said lock lever in such a manner as to bias said lock lever toward the initial position and bias said outer tubular portion and said lock lever in a direction away from each other along said center shaft, and a cam mechanism provided between said outer tubular portion and said lock lever and configured to move, in response to the rotation of said lock lever from the initial position to the locked position, said suction cup from an initially attached state which is established by pressing, with said suction face opposed to the attaching object face, said center shaft against the attaching object face until said suction face is contacted over an overall area thereof with the attaching object face and the end portion of said skirt portion is contacted with an outer circumferential portion of said rear face or with a portion of the attaching object face on the outer side in a radial direction of said rear face to a finally attached state wherein said center shaft is displaced in a direction away from the attaching object face and then retain said lock lever at the locked position against the biasing force of said coil spring, wherein said article retaining section and said outer tubular portion are connected to each other.

7. The article retaining apparatus according to claim 6, wherein said article retaining section and said outer tubular portion are connected to each other though a joint.

8. The article retaining apparatus according to claim 6, wherein said suction cup includes a suction cup body and a gel layer;

said suction cup body being formed from a resilient material while forming said rear face;

said gel layer being formed from gel and attached to said suction cup body to form said suction face.

9. The article retaining apparatus according to claim 6, wherein said suction cup further has an intermediately attached state wherein said center shaft is displaced in the direction away from the attaching object face by said coil spring from the position thereof when said suction cup is in the initially attached state, and the finally attached state is established by rotating, while said suction cup is in the intermediately attached state, said lock lever from the initial position to the locked position to further displace said center shaft in the direction away from the attaching object face.

10. The article retaining apparatus according to claim 6, wherein said lock lever has an inner tubular portion inserted between the outer circumference of said center shaft and the inner circumference of said outer tubular portion and coupled to said center shaft against movement in the axial direction of said center shaft but for rotation around said center shaft, and a lever portion for rotating operation projecting outwardly in a radial direction of said inner tubular portion from said inner tubular portion, and said cam mechanism is provided between the inner circumference of said outer tubular portion and said inner tubular portion.

* * * * *